US011033102B2

(12) United States Patent
Ergun et al.

(10) Patent No.: US 11,033,102 B2
(45) **Date of Patent: *Jun. 15, 2021**

(54) HEIGHT ADJUSTABLE DESKTOP WORK SURFACE

(71) Applicant: Ergotron, Inc., St. Paul, MN (US)

(72) Inventors: Mustafa A. Ergun, Eden Prairie, MN (US); Thiem Wong, Brooklyn, MN (US); John William Theis, St. Paul, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/709,228

(22) Filed: Dec. 10, 2019

(65) Prior Publication Data

US 2020/0221864 A1 Jul. 16, 2020

Related U.S. Application Data

(63) Continuation of application No. 15/892,167, filed on Feb. 8, 2018, now Pat. No. 10,524,565, which is a (Continued)

(51) Int. Cl.
*A47B 9/00* (2006.01)
*A47B 21/02* (2006.01)

(Continued)

(52) U.S. Cl.
CPC ..... *A47B 21/02* (2013.01); *A47B 1/04* (2013.01); *A47B 9/02* (2013.01); *A47B 9/16* (2013.01);

(Continued)

(58) Field of Classification Search
CPC .... A47B 9/00; A47B 9/16; A47B 3/02; A47B 2003/025; A47B 9/14; A47B 9/18; A47B 21/02

(Continued)

(56) References Cited

U.S. PATENT DOCUMENTS 778,799 A 12/1904 Potts et al.
1,824,822 A 9/1931 Kradolfer (Continued)

FOREIGN PATENT DOCUMENTS

AU 2015247798 B2 6/2018
CN 101744453 A 6/2010

(Continued)

OTHER PUBLICATIONS

"U.S. Appl. No. 16/779,313, Preliminary Amendment filed May 5, 2020", 6 pgs.

(Continued)

*Primary Examiner* — Matthew W Ing
(74) *Attorney, Agent, or Firm* — Schwegman Lundberg & Woessner, P.A.

(57) ABSTRACT

In one example, a height adjustable desktop system is described that can include a work surface, a foot assembly and a linkage assembly that adjustably connects the work surface to the foot assembly allowing vertical adjustment of the work surface. The linkage assembly can include a pair of adjustment assemblies, each having a transverse linkage that maintains the work surface in a horizontal orientation as the work surface is elevated or lowered. A biasing mechanism, such as an extension spring or a torsion spring, biases the work surface toward the elevated position.

20 Claims, 40 Drawing Sheets

Related U.S. Application Data continuation of application No. 14/971,227, filed on Dec. 16, 2015, now abandoned, which is a continuation of application No. 14/686,465, filed on Apr. 14, 2015, now abandoned.

(60) Provisional application No. 62/053,880, filed on Sep. 23, 2014, provisional application No. 61/979,265, filed on Apr. 14, 2014.

(51) Int. Cl.

| | |
|---|---|
| ***A47B 9/16*** | (2006.01) |
| ***A47B 9/02*** | (2006.01) |
| ***A47B 9/18*** | (2006.01) |
| ***A47B 1/04*** | (2006.01) |
| ***A47B 13/00*** | (2006.01) |
| ***A47B 21/04*** | (2006.01) |
| *A47B 23/04* | (2006.01) |

(52) U.S. Cl.
CPC ..... *A47B 9/18* (2013.01); *A47B 13/003* (2013.01); *A47B 21/04* (2013.01); *A47B 23/04* (2013.01); *A47B 2009/185* (2013.01)

(58) Field of Classification Search
USPC ..... 108/145, 147.11, 116–120, 147
See application file for complete search history.

(56) References Cited

U.S. PATENT DOCUMENTS

| | | | | |
|---|---|---|---|---|
| 2,545,515 | A | 3/1951 | Gannett et al. | |
| 2,579,577 | A | 12/1951 | Fayra | |
| 2,581,023 | A | 1/1952 | Jerick | |
| 2,630,359 | A | 3/1953 | Schade | |
| 2,643,922 | A | 6/1953 | Rudman | |
| 2,727,799 | A | 12/1955 | Keal | |
| 2,798,641 | A | 7/1957 | Coddington | |
| 3,203,373 | A | 8/1965 | King et al. | |
| 3,245,366 | A | 4/1966 | Fox | |
| 3,347,184 | A | 10/1967 | Kiraly | |
| 3,727,245 | A | 4/1973 | Gerth | |
| 3,888,451 | A | 6/1975 | Lacey | |
| 4,032,103 | A | 6/1977 | Ehrichs | |
| 4,073,240 | A | 2/1978 | Fly | |
| 4,130,069 | A | 12/1978 | Evans et al. | |
| 4,194,452 | A | 3/1980 | Crowther et al. | |
| 4,515,086 | A | 5/1985 | Kwiecinski et al. | |
| 4,534,544 | A | 8/1985 | Heide | |
| 4,558,847 | A | 12/1985 | Coates et al. | |
| 4,577,821 | A | 3/1986 | Edmo et al. | |
| 4,589,621 | A | 5/1986 | Hunt et al. | |
| 4,625,657 | A | 12/1986 | Little et al. | |
| 4,728,118 | A | 3/1988 | Haas | |
| 4,981,052 | A | 1/1991 | Gierer | |
| 4,981,085 | A | 1/1991 | Watt | |
| 5,039,054 | A | 8/1991 | Pai | |
| 5,048,784 | A | 9/1991 | Schwartz et al. | |
| 5,083,512 | A | 1/1992 | Newhouse et al. | |
| 5,088,676 | A | 2/1992 | Orchard et al. | |
| 5,174,223 | A | 12/1992 | Nagy et al. | |
| 5,192,053 | A | 3/1993 | Sehlstedt | |
| 5,251,864 | A | 10/1993 | Itou | |
| 5,322,025 | A | 6/1994 | Sherman et al. | |
| 5,325,794 | A | 7/1994 | Hontani | |
| 5,375,514 | A | 12/1994 | Dann, Jr. | |
| 5,394,809 | A | 3/1995 | Feldpausch et al. | |
| 5,490,466 | A | 2/1996 | Diffrient | |
| 5,503,086 | A | 4/1996 | Hoffman et al. | |
| 5,549,052 | A | 8/1996 | Hoffman | |
| 5,553,550 | A | 9/1996 | Doyle | |
| 5,588,377 | A | 12/1996 | Fahmian | |
| 5,649,493 | A * | 7/1997 | Blume | A47B 9/00 108/136 |
| 5,680,820 | A | 10/1997 | Randolph | |
| 5,687,655 | A | 11/1997 | Weinschenk, Jr. et al. | |
| 5,778,799 | A | 7/1998 | Eyre | |
| 5,794,911 | A | 8/1998 | Hill | |
| 5,823,120 | A | 10/1998 | Holmquist | |
| 5,833,198 | A | 11/1998 | Graetz | |
| 5,938,340 | A | 8/1999 | Brodersen | |
| 5,967,059 | A | 10/1999 | Jensen | |
| 6,026,755 | A | 2/2000 | Long | |
| 6,038,986 | A | 3/2000 | Ransil et al. | |
| 6,283,047 | B1 | 9/2001 | Haller(-Hess) | |
| 6,286,441 | B1 | 9/2001 | Burdi | |
| 6,378,446 | B1 | 4/2002 | Long | |
| 6,439,657 | B1 | 8/2002 | Tholkes | |
| 6,510,803 | B1 | 1/2003 | Agee | |
| 6,516,478 | B2 | 2/2003 | Cook et al. | |
| 6,520,091 | B1 | 2/2003 | Dettmers | |
| 6,603,157 | B2 | 8/2003 | Dupuy et al. | |
| 6,691,626 | B2 | 2/2004 | Warner | |
| 6,701,853 | B1 * | 3/2004 | Hwang | A47B 3/02 108/118 |
| 6,874,431 | B1 | 4/2005 | Danna | |
| 6,991,199 | B2 | 1/2006 | Carpentier | |
| 7,048,236 | B2 | 5/2006 | Benden et al. | |
| 7,059,254 | B2 | 6/2006 | Strong et al. | |
| 7,201,108 | B2 | 4/2007 | Eusebi et al. | |
| 7,246,784 | B1 | 7/2007 | Lopez | |
| 7,385,376 | B2 | 6/2008 | Zolfaghari | |
| 7,548,051 | B1 | 6/2009 | Tenbroek et al. | |
| 7,642,759 | B2 | 1/2010 | Dobkin | |
| 7,654,208 | B2 | 2/2010 | Patten et al. | |
| 7,677,518 | B2 | 3/2010 | Chouinard et al. | |
| 7,690,317 | B2 | 4/2010 | Beck et al. | |
| 7,849,789 | B1 | 12/2010 | Whelan | |
| 7,887,014 | B2 | 2/2011 | Lindblad et al. | |
| 7,950,338 | B2 | 5/2011 | Smed | |
| 8,065,966 | B1 | 11/2011 | Bacon et al. | |
| 8,132,518 | B2 * | 3/2012 | Kim | B66F 7/0633 108/145 |
| 8,439,319 | B2 | 5/2013 | Page et al. | |
| 8,544,391 | B2 | 10/2013 | Knox et al. | |
| 8,671,853 | B2 | 3/2014 | Flaherty | |
| 8,783,639 | B2 | 7/2014 | Lindblad et al. | |
| 8,800,454 | B2 | 8/2014 | Jones | |
| 8,931,750 | B2 | 1/2015 | Kohl et al. | |
| 8,950,343 | B2 | 2/2015 | Huang | |
| 9,049,923 | B1 | 6/2015 | Delagey | |
| 9,055,810 | B2 | 6/2015 | Flaherty | |
| 9,072,645 | B2 | 7/2015 | Gamman et al. | |
| 9,113,703 | B2 | 8/2015 | Flaherty | |
| 9,668,572 | B2 * | 6/2017 | Ergun | A47B 9/16 |
| 10,244,861 | B1 | 4/2019 | Poniatowski | |
| 10,524,565 | B2 * | 1/2020 | Ergun | A47B 9/02 |
| 10,542,817 | B2 | 1/2020 | Swartz et al. | |
| 10,602,840 | B2 | 3/2020 | Ergun et al. | |
| 2002/0189505 | A1 | 12/2002 | Markofer | |
| 2003/0213415 | A1 | 11/2003 | Ross et al. | |
| 2004/0047645 | A1 | 3/2004 | No et al. | |
| 2004/0187742 | A1 | 9/2004 | Eusebi et al. | |
| 2004/0227443 | A1 | 11/2004 | Sandoval | |
| 2005/0248239 | A1 | 11/2005 | Newhouse | |
| 2005/0279261 | A1 | 12/2005 | Lo | |
| 2006/0037518 | A1 | 2/2006 | Lopez Alba | |
| 2006/0038383 | A1 | 2/2006 | Wu | |
| 2006/0157628 | A1 | 7/2006 | Mileos et al. | |
| 2007/0163475 | A1 | 7/2007 | Murphy | |
| 2007/0259554 | A1 | 11/2007 | Lindblad | |
| 2007/0266912 | A1 | 11/2007 | Swain et al. | |
| 2007/0295882 | A1 | 12/2007 | Catton | |
| 2008/0308016 | A1 | 12/2008 | Meyer | |
| 2009/0179121 | A1 | 7/2009 | Lindblad et al. | |
| 2010/0242174 | A1 | 9/2010 | Morrison, Sr. et al. | |
| 2010/0257671 | A1 | 10/2010 | Shimada et al. | |
| 2011/0120351 | A1 | 5/2011 | Shoenfeld | |
| 2011/0168062 | A1 | 7/2011 | Dellavecchia | |
| 2011/0247532 | A1 | 10/2011 | Jones | |
| 2013/0014674 | A1 | 1/2013 | Burkhalter | |
| 2013/0139736 | A1 | 6/2013 | Flaherty | |
| 2013/0145972 | A1 | 6/2013 | Knox et al. | |

(56) References Cited

U.S. PATENT DOCUMENTS

| | | | | |
|---|---|---|---|---|
| 2013/0199420 | A1 | 8/2013 | Hjelm | |
| 2013/0340655 | A1 | 12/2013 | Flaherty | |
| 2014/0020606 | A1 | 1/2014 | Benden | |
| 2014/0041554 | A1 | 2/2014 | Huang | |
| 2014/0144352 | A1 | 5/2014 | Roberts | |
| 2014/0158026 | A1* | 6/2014 | Flaherty | A47B 21/03 108/96 |
| 2014/0165882 | A1 | 6/2014 | Plikat et al. | |
| 2014/0360411 | A1 | 12/2014 | Hatter | |
| 2015/0164218 | A1 | 6/2015 | Bonuccelli | |
| 2015/0216296 | A1 | 8/2015 | Mitchell | |
| 2015/0231992 | A1 | 8/2015 | Gundall et al. | |
| 2015/0250303 | A1 | 9/2015 | Flaherty | |
| 2015/0289641 | A1 | 10/2015 | Ergun et al. | |
| 2016/0120300 | A1 | 5/2016 | Ergun et al. | |
| 2016/0198853 | A1 | 7/2016 | Liu | |
| 2016/0278515 | A1 | 9/2016 | Ergun et al. | |
| 2016/0338486 | A1 | 11/2016 | Martin | |
| 2017/0164728 | A1 | 6/2017 | Chang | |
| 2017/0354245 | A1 | 12/2017 | Martin et al. | |
| 2017/0360188 | A1 | 12/2017 | Alguire | |
| 2018/0103752 | A1 | 4/2018 | Zhong | |
| 2018/0146775 | A1 | 5/2018 | You et al. | |
| 2018/0160799 | A1 | 6/2018 | Westergård et al. | |
| 2018/0213929 | A1 | 8/2018 | Ergun et al. | |
| 2018/0255919 | A1 | 9/2018 | Swartz et al. | |
| 2018/0279772 | A1 | 10/2018 | Ergun et al. | |
| 2020/0187637 | A1 | 6/2020 | Lin | |
| 2020/0237093 | A1 | 7/2020 | Ergun et al. | |

FOREIGN PATENT DOCUMENTS

| | | | |
|---|---|---|---|
| CN | 202681006 | U | 1/2013 |
| CN | 203505908 | U | 4/2014 |
| CN | 106793868 | A | 5/2017 |
| CN | 108024625 | A | 5/2018 |
| CN | 106793868 | B | 6/2020 |
| CN | 111642896 | A | 9/2020 |
| DE | 7114367 | U | 6/1972 |
| DE | 4336833 | A1 | 6/1994 |
| DE | 4424564 | A1 | 1/1996 |
| DE | 19517825 | A1 | 11/1996 |
| DE | 102012110389 | A1 | 4/2014 |
| DE | 202016102015 | U1 | 5/2016 |
| EP | 0142919 | A1 | 5/1985 |
| EP | 0229585 | A1 | 7/1987 |
| EP | 0706769 | A2 | 4/1996 |
| EP | 2745733 | A1 | 6/2014 |
| EP | 2842458 | A1 | 3/2015 |
| FR | 1093171 | A | 5/1955 |
| GB | 688572 | A | 3/1953 |
| GB | 857199 | A | 12/1960 |
| GB | 2341790 | A | 3/2000 |
| JP | S58761051 | U | 4/1983 |
| JP | 5950172 | B1 | 7/2016 |
| JP | 2017511246 | A | 4/2017 |
| KR | 101527121 | B1 | 6/2015 |
| WO | WO 9000868 | A1 | 2/1990 |
| WO | WO-90000868 | A1 | 2/1990 |
| WO | WO-9515097 | A1 | 6/1995 |
| WO | WO-9952398 | A1 | 10/1999 |
| WO | WO-2004047645 | A1 | 6/2004 |
| WO | WO-2005041721 | A2 | 5/2005 |
| WO | WO-2015060825 | A3 | 10/2015 |
| WO | WO-2015190825 | A2 | 10/2015 |
| WO | WO-2016129971 | | 8/2016 |
| WO | WO-2016200318 | A1 | 12/2016 |
| WO | WO-2016209513 | A1 | 12/2016 |
| WO | WO-2017053200 | A1 | 3/2017 |
| WO | WO-2017062589 | A1 | 4/2017 |

OTHER PUBLICATIONS

"Chinese Application Serial No. 202010425151.7, Notification to Make Rectification dated Jun. 8, 2020", W/O English Translation, 1 page.

"Application file No. PCT/US2016/055704 International Preliminary Report on Patentability dated Apr. 19, 2018", 9 pgs.

"U.S. Appl. No. 14/686,465, Non Final Office Action dated Mar. 9, 2016", 12 pgs.

"U.S. Appl. No. 14/686,465, Non Final Office Action dated Jul. 29, 2016", 11 pgs.

"U.S. Appl. No. 14/686,465, Non Final Office Action dated Nov. 12, 2015", 11 pgs.

"U.S. Appl. No. 14/686,465, Response filed Feb. 8, 2016 to Non Final Office Action dated Nov. 12, 2015", 12 pgs.

"U.S. Appl. No. 14/686,465, Response filed Jul. 11, 2016 to Non Final Office Action dated Mar. 9, 2016", 11 pgs.

"U.S. Appl. No. 14/686,465, Response filed Oct. 28, 2015 to Restriction Requirement dated Aug. 28, 2015", 8 pgs.

"U.S. Appl. No. 14/686,465, Restriction Requirement dated Aug. 28, 2015", 6 pgs.

"U.S. Appl. No. 14/971,227, Advisory Action dated Jan. 23, 2017", 4 pgs.

"U.S. Appl. No. 14/971,227, Final Office Action dated Nov. 2, 2016", 9 pgs.

"U.S. Appl. No. 14/971,227, Final Office Action dated Nov. 8, 2017", 13 pgs.

"U.S. Appl. No. 14/971,227, Non Final Office Action dated Mar. 17, 2017", 14 pgs.

"U.S. Appl. No. 14/971,227, Non Final Office Action dated Jul. 11, 2016", 13 pgs.

"U.S. Appl. No. 14/971,227, Response filed Feb. 27, 2017 to Advisory Action dated Jan. 23, 2017", 20 pgs.

"U.S. Appl. No. 14/971,227, Response filed Apr. 6, 2016 to Restriction Requirement dated Feb. 11, 2016", 6 pgs.

"U.S. Appl. No. 14/971,227, Response filed Jul. 17, 2017 to Non Final Office Action dated Mar. 17, 2017", 21 pgs.

"U.S. Appl. No. 14/971,227, Response filed Sep. 29, 2016 to Non Final Office Action dated Jul. 11, 2016", 11 pgs.

"U.S. Appl. No. 14/971,227, Response filed Dec. 28, 2016 to Final Office Action dated Nov. 2, 2016", 15 pgs.

"U.S. Appl. No. 14/971,227, Restriction Requirement dated Feb. 11, 2016", 6 pgs.

"U.S. Appl. No. 15/178,794, Examiner Interview Summary dated Dec. 12, 2016", 3 pgs.

"U.S. Appl. No. 15/178,794, Non Final Office Action dated Nov. 15, 2016", 16 pgs.

"U.S. Appl. No. 15/178,794, Notice of Allowance dated Feb. 8, 2017", 7 pgs.

"U.S. Appl. No. 15/178,794, Response filed Aug. 25, 2016 to Restriction Requirement dated Jul. 14, 2016", 7 pgs.

"U.S. Appl. No. 15/178,794, Response filed Dec. 28, 2016 to Non Final Office Action dated Nov. 15, 2016", 19 pgs.

"U.S. Appl. No. 15/178,794, Restriction Requirement dated Jul. 14, 2016", 5 pgs.

"U.S. Appl. No. 15/762,427, Non Final Office Action dated Apr. 24, 2019", 10 pgs.

"U.S. Appl. No. 15/762,427, Response filed Mar. 21, 2019 to Restriction Requirement dated Mar. 4, 2019", 7 pgs.

"U.S. Appl. No. 15/762,427, Response filed Jul. 23, 2019 to Non-Final Office Action dated Apr. 24, 2019", 11 pgs.

"U.S. Appl. No. 15/762,427, Restriction Requirement dated Mar. 4, 2019", 7 pgs.

"U.S. Appl. No. 15/763,803, Final Office Action dated May 10, 2019", 12 pgs.

"U.S. Appl. No. 15/763,803, Non Final Office Action dated Dec. 5, 2018", 11 pgs.

"U.S. Appl. No. 15/763,803, Response filed Mar. 4, 2019 to Non Final Office Action dated Dec. 5, 2018", 11 pgs.

"U.S. Appl. No. 15/892,167, Corrected Notice of Allowability dated Nov. 26, 2019", 2 pgs.

"U.S. Appl. No. 15/892,167, Non Final Office Action dated Feb. 19, 2019", 12 pgs.

"U.S. Appl. No. 15/892,167, Notice of Allowance dated Jul. 31, 2019", 5 pgs.

(56) References Cited

OTHER PUBLICATIONS

"U.S. Appl. No. 15/892,167, Preliminary Amendment filed Feb. 21, 2018", 8 pgs.
"U.S. Appl. No. 15/892,167, PTO Response to Rule 312 Communication dated Nov. 18, 2019", 2 pgs.
"U.S. Appl. No. 15/892,167, Response filed Jun. 19, 2019 to Non-Final Office Action dated Feb. 19, 2019", 9 pgs.
"U.S. Appl. No. PCT/US2016/052233, International Preliminary Report on Patentability dated Apr. 5, 2018", 12 pgs.
"Australian Application Serial No. 2015247798, First Examiners Report dated Oct. 31, 2017", 6 pgs.
"Australian Application Serial No. 2015247798, Response filed Jan. 24, 2018 to First Examiners Report dated Oct. 31, 2017", 50 pgs.
"Chinese Application Serial No. 201580024630.5, Office Action dated Dec. 29, 2018", w/ English translation, 23 pgs.
"Chinese Application Serial No. 201580024630.5, Response filed May 13, 2019 to Office Action dated Dec. 29, 2018", w/ English claims, 13 pgs.
"Chinese Application Serial No. 201580024630.5, Voluntary Amendment filed Aug. 25, 2017", w/ claims in English, 13 pgs.
"Computer Taskmate HealthPostures Feel Better in motion", [Online]. Retrieved from the Internet: <URL: www.healthpostures.com>, 3 pgs.
"Computer Taskmate tm Product Information", [Online]. Retrieved from the Internet: <URL: www.varidesk.com>, 2 pgs.
"European Application No. 15780177,0, Office Action dated Nov. 22, 2016", 2 pg.
"European Application Serial No. 15780177.0, Extended European Search Report dated Feb. 2, 2018", 12 pgs.
"European Application Serial No. 15780177.0, Invitation pursuant to Rule 63(1) EPC dated Oct. 6, 2017", 3 pgs.
"European Application Serial No. 16784658.3, Response filed Dec. 17, 2018 to Communication Pursuant to Rules 161 and 162 dated Jun. 7, 2018", 21 pgs.
"European Application Serial No. 18175257.7, Extended European Search Report dated Nov. 2, 2018", 9 pgs.
"European Application Serial No. 18175257.7, Response filed Jul. 2, 2019 to Extended European Search Report dated Nov. 2, 2018", 17 pgs.
"International Application Serial No. PCT/US2015/025780, International Preliminary Report on Patentability dated Oct. 27, 2016", 7 pgs.
"International Application Serial No. PCT/US2015/025780, International Search Report dated Dec. 7, 2015", 2 pgs.
"International Application Serial No. PCT/US2015/025780, Written Opinion dated Dec. 7, 2015", 5 pgs.
"International Application Serial No. PCT/US2016/052233, International Search Report dated Dec. 1, 2017", 6 pgs.
"International Application Serial No. PCT/US2016/052233, Invitation to Pay Add'l Fees and Partial Search Report dated Nov. 8, 2016", 6 pgs.
"International Application Serial No. PCT/US2016/052233, Written Opinion dated Dec. 1, 2017", 10 pgs.
"International Application Serial No. PCT/US2016/055704, International Search Report dated Dec. 20, 2016", 5 pgs.
"International Application Serial No. PCT/US2016/055704, Written Opinion dated Dec. 20, 2016", 7 pgs.
"Office Theme", [Online]. Retrieved from the Internet: <URL: Varidesk.com>., 6 pgs.
"Sales Order Form re: Taskmate", Products shipped from HealthPostures, LLC. to ARC Ergonomics, (Sep. 30, 2008), 2 pgs.
Dai, et al., "CN 107048694 (A), Drawings and Abstract", Derwent—Thomson Reuters, (2017), 3 pgs.
"U.S. Appl. No. 15/762,427, Notice of Allowance dated Aug. 26, 2019", 7 pgs.
"U.S. Appl. No. 15/763,803, Advisory Action dated Aug. 23, 2019", 3 pgs.
"U.S. Appl. No. 15/763,803, Corrected Notice of Allowability dated Jan. 13, 2020", 2 pgs.
"U.S. Appl. No. 15/763,803, Corrected Notice of Allowability dated Feb. 12, 2020", 2 pgs.
"U.S. Appl. No. 15/763,803, Notice of Allowance dated Oct. 1, 2019", 6 pgs.
"U.S. Appl. No. 15/763,803, Notice of Allowance dated Oct. 30, 2019", 6 pgs.
"U.S. Appl. No. 15/763,803, Response filed Aug. 12, 2019 to Final Office Action dated May 10, 2019", 15 pgs.
"U.S. Appl. No. 15/763,803, Response filed Sep. 10, 2019 to Advisory Action dated Aug. 23, 2019", 7 pgs.
"Canadian Application Serial No. 2,999,757, Office Action dated Jan. 18, 2019", 4 pgs.
"Canadian Application Serial No. 2,999,757, Response filed Jul. 17, 2019 to Office Action dated Jan. 18, 2019", 16 pgs.
"Chinese Application Serial No. 201580024630.5, Office Action dated Aug. 5, 2019", w/ English Translation, 16 pgs.
"Chinese Application Serial No. 201580024630.5, Response filed Oct. 21, 2019 to Office Action dated Aug. 5, 2019", w/ English claims, 13 pgs.
"European Application Serial No. 16777839.8, Communication Pursuant to Article 94(3) EPC dated Jun. 5, 2019", 4 pgs.
"European Application Serial No. 16777839.8, Communication Under Rule 164(2)(a) EPC dated Feb. 20, 2019", 4 pgs.
"European Application Serial No. 16777839.8, Response filed Oct. 9, 2018 to Communication Pursuant to Rules 161 and 162 EPC dated May 7, 2018", 20 pgs.
"European Application Serial No. 18175257.7, Communication Pursuant to Article 94(3) EPC dated Mar. 16, 2020", 4 pgs.
"European Application Serial No. 18175257.7, Communication Pursuant to Article 94(3) EPC dated Oct. 10, 2019", 5 pgs.
"European Application Serial No. 18175257.7, Response filed Feb. 20, 2020 to Communication Pursuant to Article 94(3) EPC dated Oct. 10, 2019", 11 pgs.
"International Application Serial No. PCT/US2016/034156, International Preliminary Report on Patentability dated Jan. 4, 2018", 9 pgs.
"International Application Serial No. PCT/US2016/034156, International Search Report dated Aug. 2, 2016", 3 pgs.
"International Application Serial No. PCT/US2016/034156, Written Opinion dated Aug. 2, 2016", 7 pgs.
"U.S. Appl. No. 16/779,313, Non Final Office Action dated Nov. 10, 2020", 7 pgs.
"Chinese Application Serial No. 202010425151.7, Response dated Jul. 30, 2020 to Notification to Make Rectification dated Jun. 8, 2020", w/ current English claims, 21 pgs.
"European Application Serial No. 18175257.7, Communication Pursuant to Article 94(3) EPC dated Sep. 23, 2020", 5 pgs.
"European Application Serial No. 18175257.7, Response dated Jul. 14, 2020 to Communication Pursuant to Article 94(3) EPC dated Mar. 16, 2020", 21 pgs.
"European Application Serial No. 16784658.3, Communication Pursuant to Article 94(3) EPC dated Dec. 8, 2020", 6 pgs.
"European Application U.S. Serial No. 18175257/, Response dated Feb. 3, 2021 to Communication Pursuant to Article 94(3) EPC dated Sep. 23, 2020", 10 pgs.
"U.S. Appl. No. 16/779,313, Response dated Mar. 9, 2021 to Non Final Office Action dated Nov. 10, 2020", 7 pgs.
"U.S. Appl. No. 16/779,313, Notice of Allowance dated Mar. 30, 2021", 5 pgs.

* cited by examiner

HEIGHT ADJUSTABLE DESKTOP WORK SURFACE

CLAIM OF PRIORITY

This patent application is a continuation of U.S. patent application Ser. No. 15/892,167, entitled "HEIGHT ADJUSTABLE DESKTOP WORK SURFACE," filed on Feb. 8, 2018, to Mustafa A. Ergun et al., which is a continuation of U.S. patent application Ser. No. 14/971,227, entitled "HEIGHT ADJUSTABLE DESKTOP WORK SURFACE," filed on Dec. 16, 2015, to Mustafa A. Ergun et al., which is a continuation of U.S. patent application Ser. No. 14/686,465, entitled "HEIGHT ADJUSTABLE DESKTOP WORK SURFACE," filed on Apr. 14, 2015, to Mustafa A. Ergun et al., which claims the benefit of priority, under 35 U.S.C. Section 119(e), to Mustafa A. Ergun et al., U.S. Patent Application Ser. No. 61/979,265, entitled "HEIGHT ADJUSTABLE DESKTOP WORK SURFACE," filed on Apr. 14, 2014 and Mustafa A. Ergun, U.S. Patent Application Ser. No. 62/053,880, entitled "HEIGHT ADJUSTABLE DESKTOP WORKSTATION," filed on Sep. 23, 2014, the benefit of priority of each of which is claimed hereby, and each of which are incorporated by reference herein in its entirety.

TECHNICAL FIELD

This document pertains generally, but not by way of limitation, to a desktop assembly for providing a height adjustable work surface.

BACKGROUND

Conventional desks include a planar desktop providing a work surface and for receiving a computer monitor, computer peripherals or other desktop items. Typically, the desktop is mounted at a horizontal position to provide a flat surface for receiving and retaining desktop items. Similarly, the desktop is positioned at a height that corresponds to a position at which a seated person can comfortably use the desk. Recently, desk users have sought to use desks while standing to prevent back strain and other injuries that result from extended seated use of the desk and in particular computer use, which often results in the user being hunched over the desktop. In particular, recent information has indicated that alternating between standing and sitting while using a desk for extending periods of time has beneficial health benefits.

An approach for providing standing use of a desk for computer use is a computer mount including a vertical riser mountable to the work surface of a desk. Fixed or height adjustable mounts for a computer monitor and/or keyboard can be secured to the vertical riser at appropriate heights for standing or alternating between sitting and standing use of the computer. A drawback of this approach is that the monitor is typically fixed to the work surface to avoid tipping. Risers can be fixed to the work surface with an edge clamp, grommet mount or other clamping apparatuses. A drawback of clamping apparatus is that the existing desktop may have to be modified by drilling holes or removing edge sections of the desktop. The substantial and permanent modification of the desk requires substantial investment and can render the desktop unsuitable for its original intended use or other uses.

OVERVIEW

The present inventors have recognized, among other things, that a problem to be solved can include providing a stable, height adjustable work surface that is sufficiently sized for computer and other uses. In addition, the present inventors have recognized that a related problem to be solved can include converting fixed height desks to a sit-to-stand desk by incorporating a height adjustable work surface. In an example, the present subject matter can provide a solution to this problem, such as by providing a height adjustable work surface that can be set or located on a fixed height desk to convert the fixed height desk. In an example, the height adjustable work surface can have a foot assembly and a linkage assembly that adjustably connects the work surface to the foot assembly allowing vertical adjustment of the work surface relative to the foot assembly. In at least one example, the foot assembly can be placed on or releasably mounted to a work surface of a fixed height desk to provide a stable, height adjustable work surface on the fixed height desk.

In an example, the linkage assembly can include one or more adjustment assemblies, each having at least two parallel linkages and a transverse linkage that maintains the work surface in a generally horizontal orientation as the work surface is elevated or lowered. One of the parallel linkages can rotate in a first plane while the second rotating linkage can rotate in second plane parallel to and offset from the first plane. The offset of the planes can reduce torqueing of the of the work surface relative to the foot assembly. In at least one example, each adjustment assembly can include a gliding upper bar that moves a glide support to elevate and lower the work surface and can also operate to maintain the work surface in a generally horizontal orientation. In at least one example, each adjustment assembly can include a biasing mechanism such as an extension spring or a torsion spring that biases the work surface toward the elevated position. In at least one example, each adjustment assembly can include a gliding upper bar that moves a glide support to elevate and lower the work surface and can also operate to maintain the work surface in a generally horizontal orientation. In this configuration, the glide rod can include a plurality of indentations that can be rotated between a first position in which the notches engage the glider to prevent adjustment of the work surface and a second position allowing lowering and raising of the work surface.

In at least one example, each adjustment assembly can include a lock lever assembly including a plunger pin that engages one of a plurality of holes in the transverse linkage to fix adjustment assembly preventing elevating or lowering of the work surface.

In an example, the height adjustable desktop can include at least one clamping member such as a clamp, a grommet, a vise, a clip, or an alternative type of fastener for securing the height adjustable desktop to a desktop, table, desk frame, wall or other structure. Securing the base foot assembly or other portion of the height adjustable desktop assembly to the desktop can improve the stability of the work surface during uses such as typing. In at least one example, each clamping members can be located in the front of the foot assembly or base and in another example; one or more clamping members can be located at the rear. In another example, a grommet mount can be used to attach the base to the desktop. The grommet mount can allow the height adjustable desk assembly to be rotated relative to the underlying supporting surface.

In an example, a height adjustable desktop system can include a work surface, a foot assembly and an adjustment assembly. The work surface can define an underside and include a glide support and a support bracket positioned on the underside of the work surface. The foot assembly can include at least one foot bracket. The adjustment assembly can include a glider slidable on the glide support, a first linkage rotatably connected to the glider and rotatably connected to the foot bracket, a second linkage rotatable with the first linkage, the second linkage rotatably connected to the glider and rotatably connected to the foot bracket, and a transverse linkage rotatably connected to the support bracket and rotatably connected to the second linkage. The glider can be slid on the glide support between a first position proximate to the support bracket and a second position distal to the support bracket; wherein the first, second and transverse linkages can be extended when the glide is positioned in the first position to position the work surface at an elevated position, wherein the first, second and transverse linkages can be collapsed when the glide is positioned in the second position to position the work surface at a lowered position.

In an example, the glide support can include a glide rod defining a plurality of indentations. In this configuration, the glider can define a first glide hole and a second glide hole aligned with the first glide hole, wherein the glide rod can be receivable in the first and second glide hole such that the glider is slidable on the glide rod. The second glide hole can define a flat edge. The glide rod can be rotated between a first position in which the indentations can be aligned to engage the flat edge to prevent sliding of the glider on the glide rod and a second position in which the indentations are out of alignment with the flat edge to allow sliding of the glider on the glide rod.

In an example, the transverse linkage can include a fan portion and defines a plurality of holes in the fan portion arranged in an arc. The height adjustable desktop system can also include a piston having a piston pin. The piston pin can be moved between an extended position in which the pin intersects one of the holes to prevent rotation of the transverse linkage and fixing elevation of the work surface and a retracted position allowing rotation of the transverse linkage permitting movement of the work surface.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
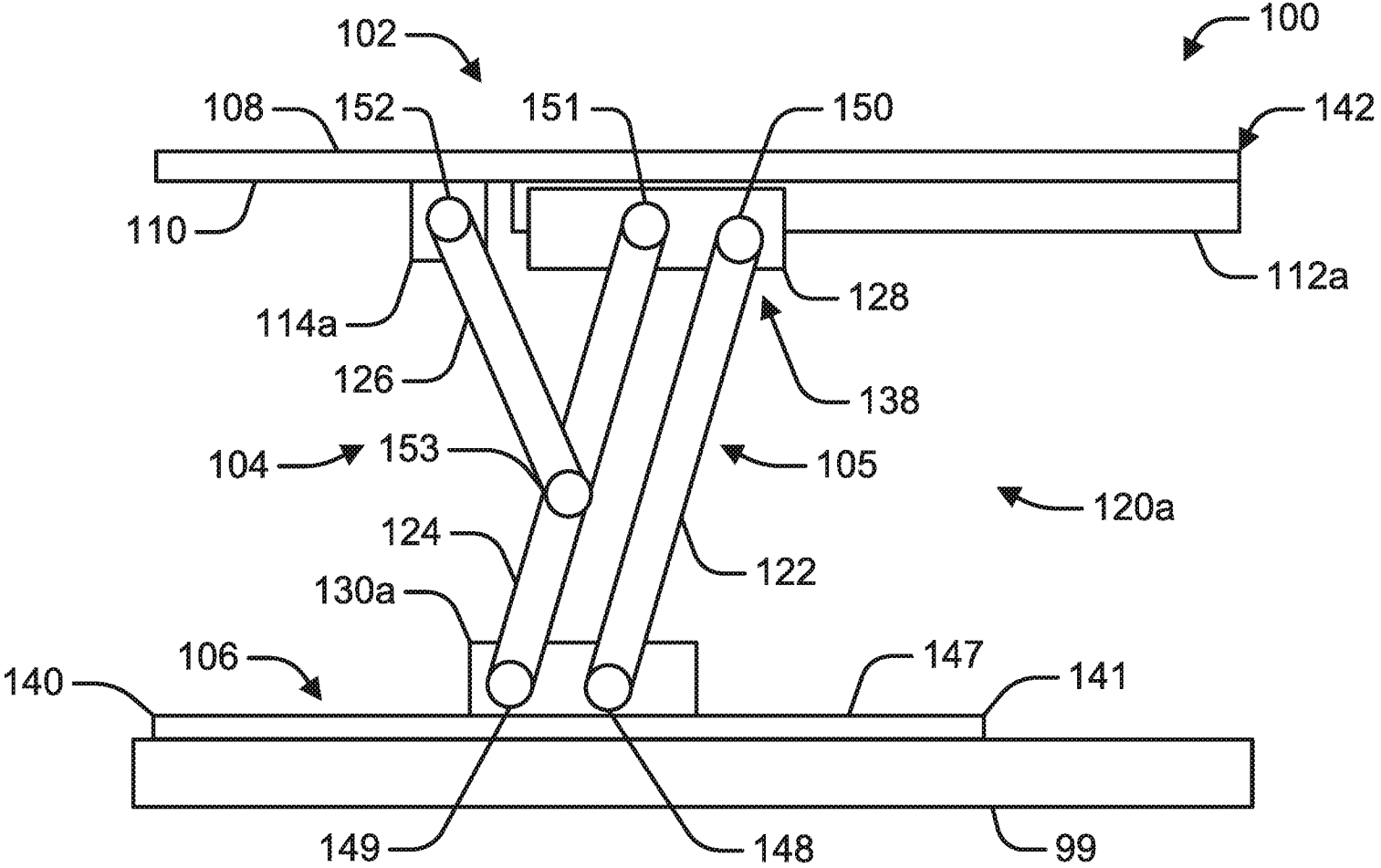
FIG. 1 is a schematic side view of a height adjustable desktop system having a work surface in an elevated position, according to an example of the present disclosure.
Figure 2:
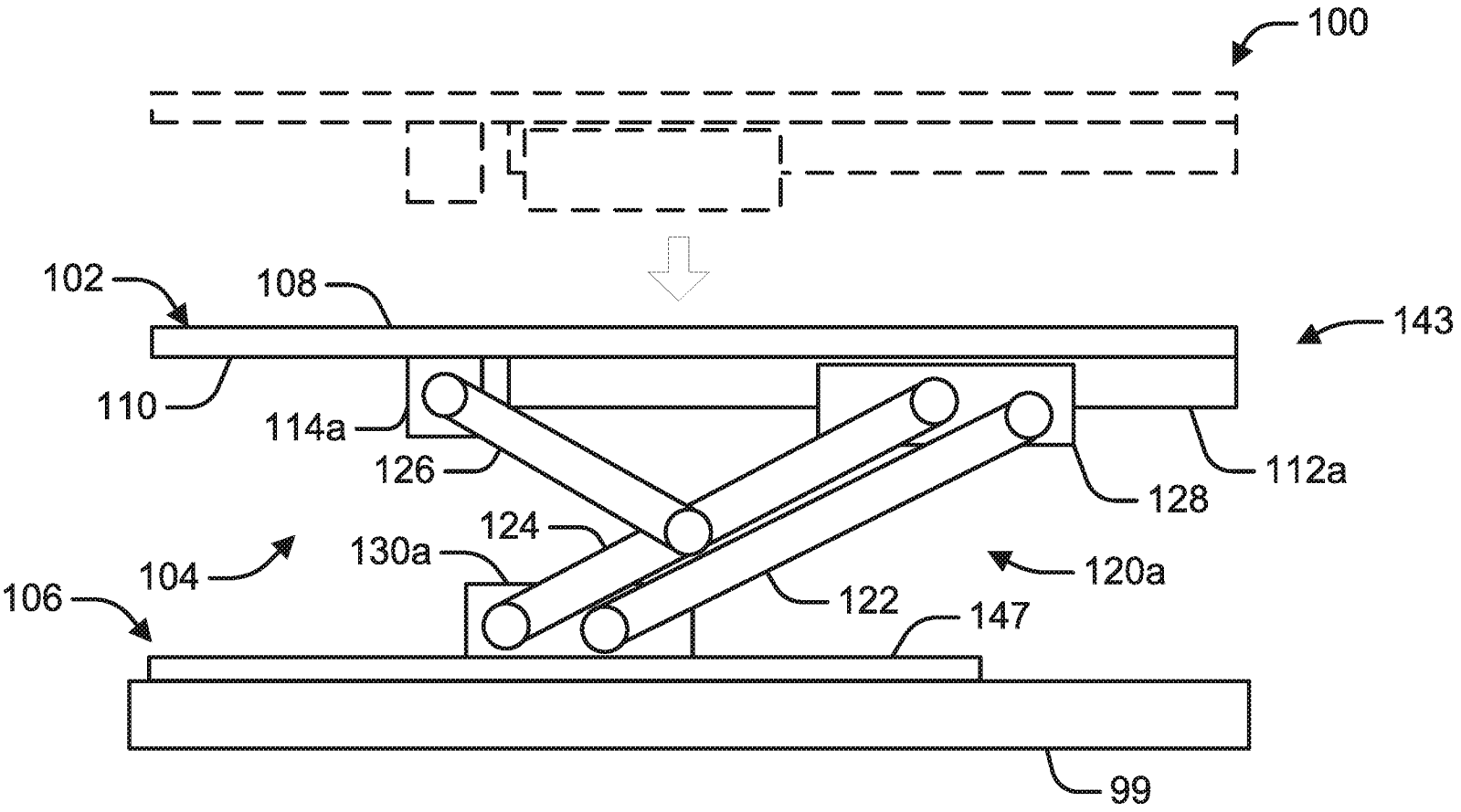
FIG. 2 is a schematic side view of the height adjustable desktop system depicted in FIG. 1 having the work surface positioned in an intermediate lowered position, according to an example of the present disclosure.
Figure 3:
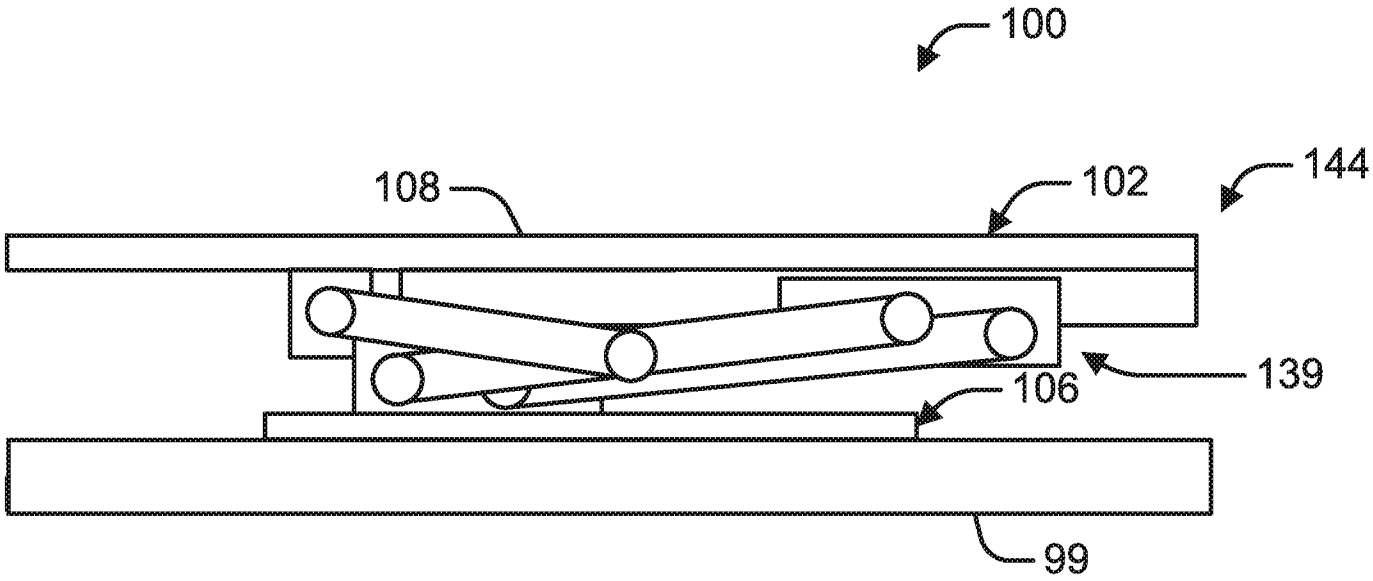
FIG. 3 is a schematic side view of the height adjustable desktop system depicted in FIG. 1 having the work surface including a shelf positioned in a lowered position, according to an example of the present disclosure.

As depicted in FIGS. 1-3, a height adjustable desktop system 100, according to an example of the present disclosure, can include a work surface 102, a linkage assembly 104 and a foot assembly 106. The work surface 102 provides a planar surface for writing or receiving desktop items such as computer peripherals. The foot assembly 106 is configured to be placed on a desktop 99 of a desk, secured to the frame of the desk or secured to a wall or other structure. The linkage assembly 104 operably connects the work surface 102 to the foot assembly 106. The linkage assembly 104 is configured to position the work surface 102 for vertical height adjustment of the work surface 102 and permitting use of the work surface 102 while seated, standing or in other positions. As illustrated in FIG. 2, in an example, the linkage assembly 104 can elevate as depicted in FIG. 1 or lower the work surface 102 relative to the foot assembly 106 as depicted in FIG. 3.

Figure 4:
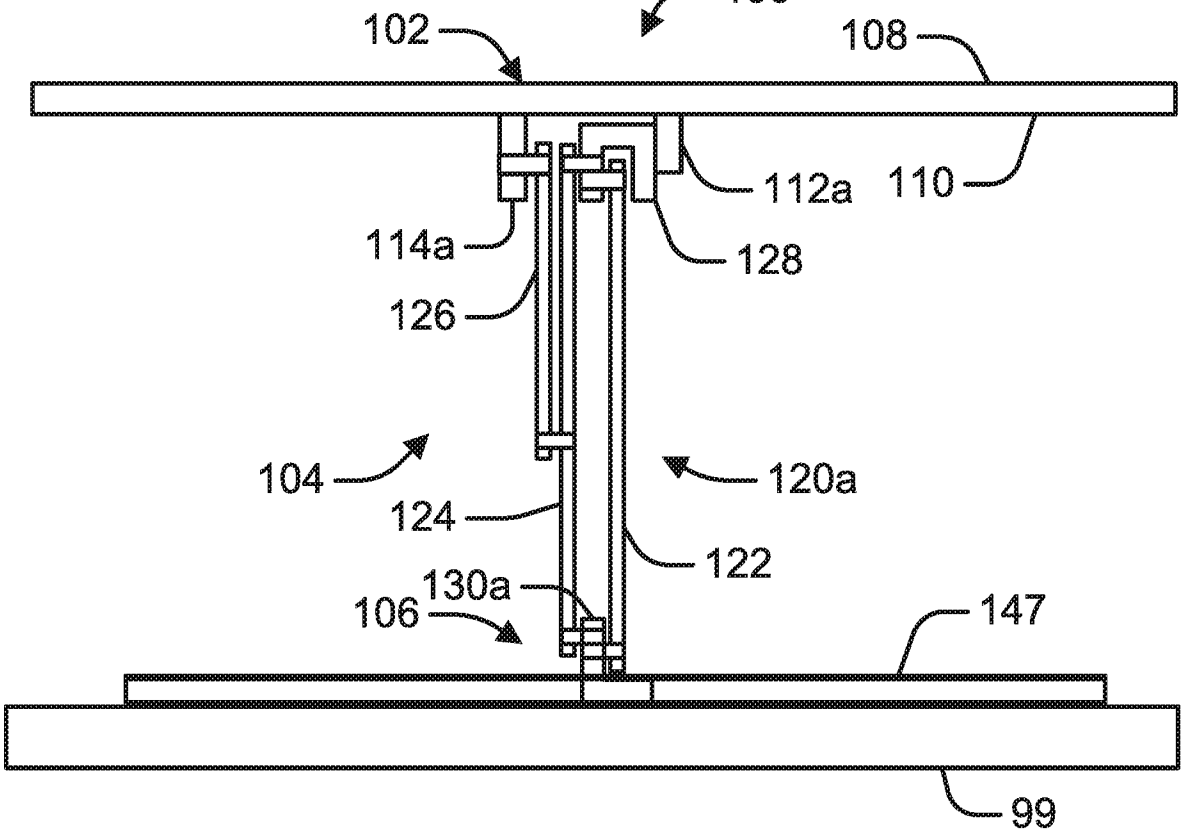
FIG. 4 is a front view of the height adjustable desktop system depicted in FIG. 1 in accordance to an example of the present disclosure.

As depicted in FIGS. 1-6, the work surface 102 can define a primary top surface 108 and an underside 110. The top surface 108 can be planar to provide a flat surface for writing or receiving desktop items. In an example, the primary top surface 108 can include a high friction surface to prevent desktop items from sliding on the primary top surface 108 while the work surface 102 is being elevated or lowered by the linkage assembly 104. As depicted in FIG. 4, in at least one example, the work surface 102 can include at least one glide support 112 and a support bracket 114 arranged on the underside 110 of the work surface 102 along an axis. In this configuration, a first adjustment assembly 120*a* can be located proximate the center of the work surface 102. The foot assembly 106 can be large enough to maintain stability of the work surface 102 during use of the height adjustable desktop system 100.

Figure 5:
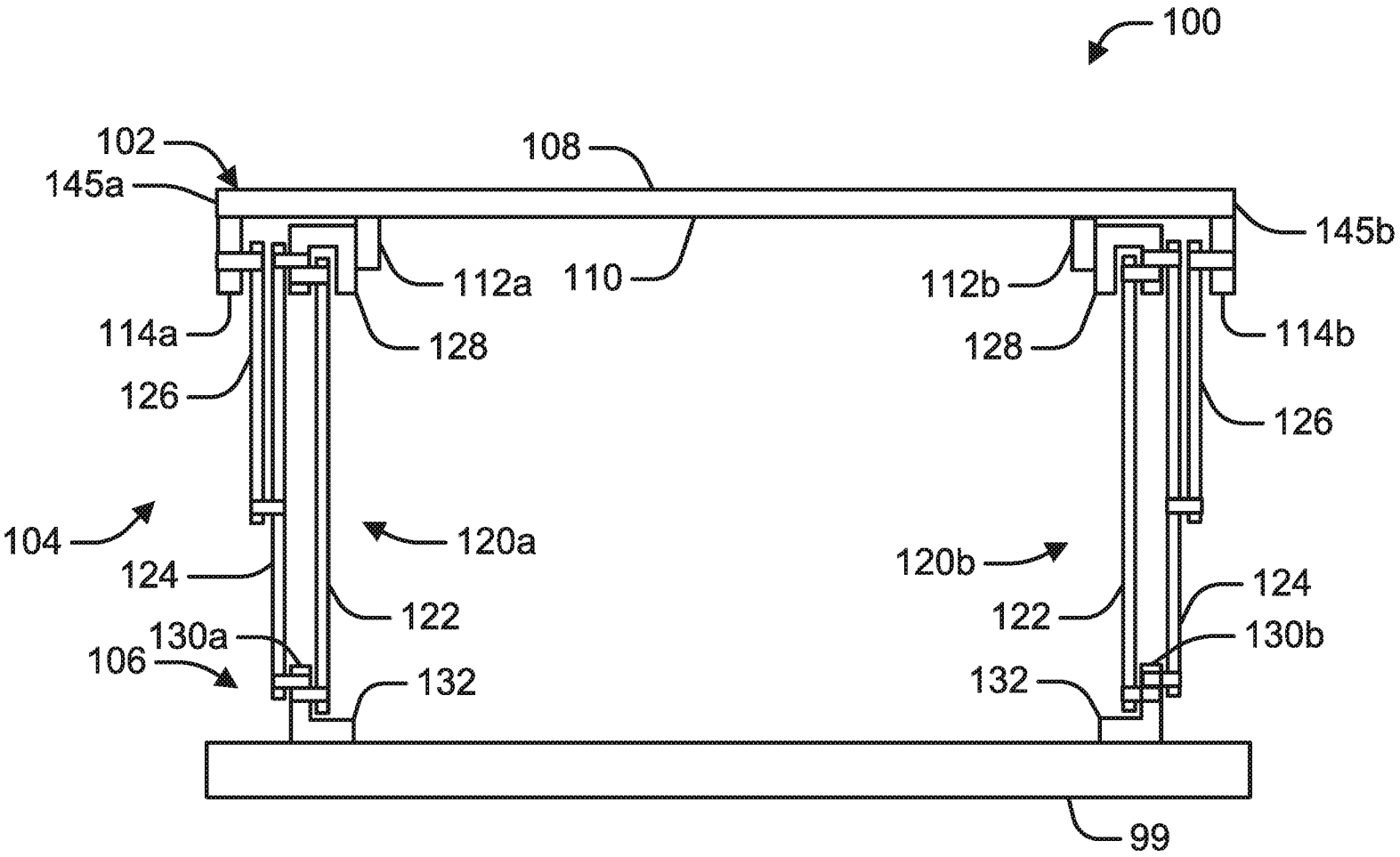
FIG. 5 is a schematic front view of the height adjustable desktop system having a work surface in an elevated position, according to an example of the present disclosure.
Figure 6:
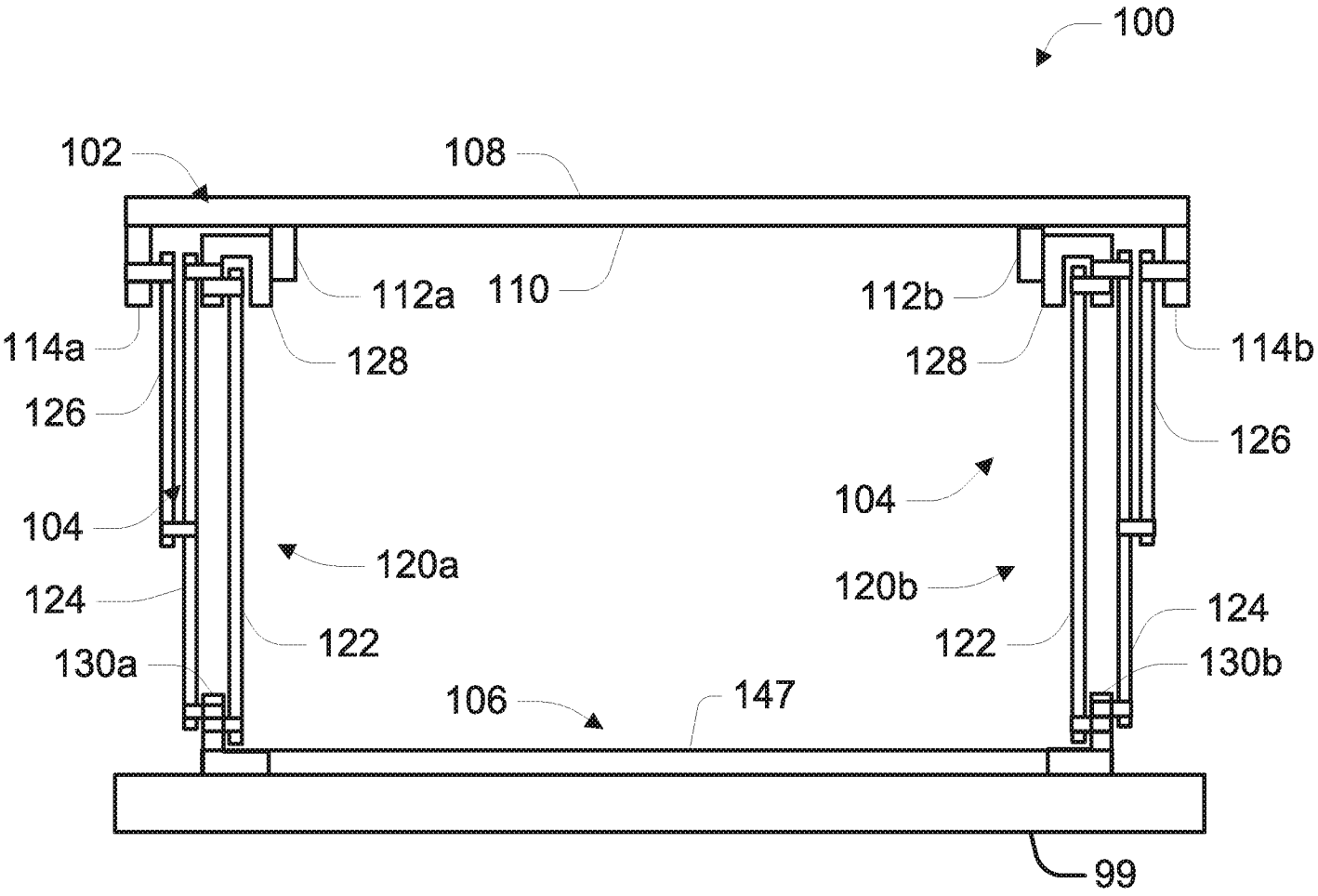
FIG. 6 is a schematic front view of the height adjustable desktop system having a work surface in an elevated position, according to an example of the present disclosure.
Figure 7:
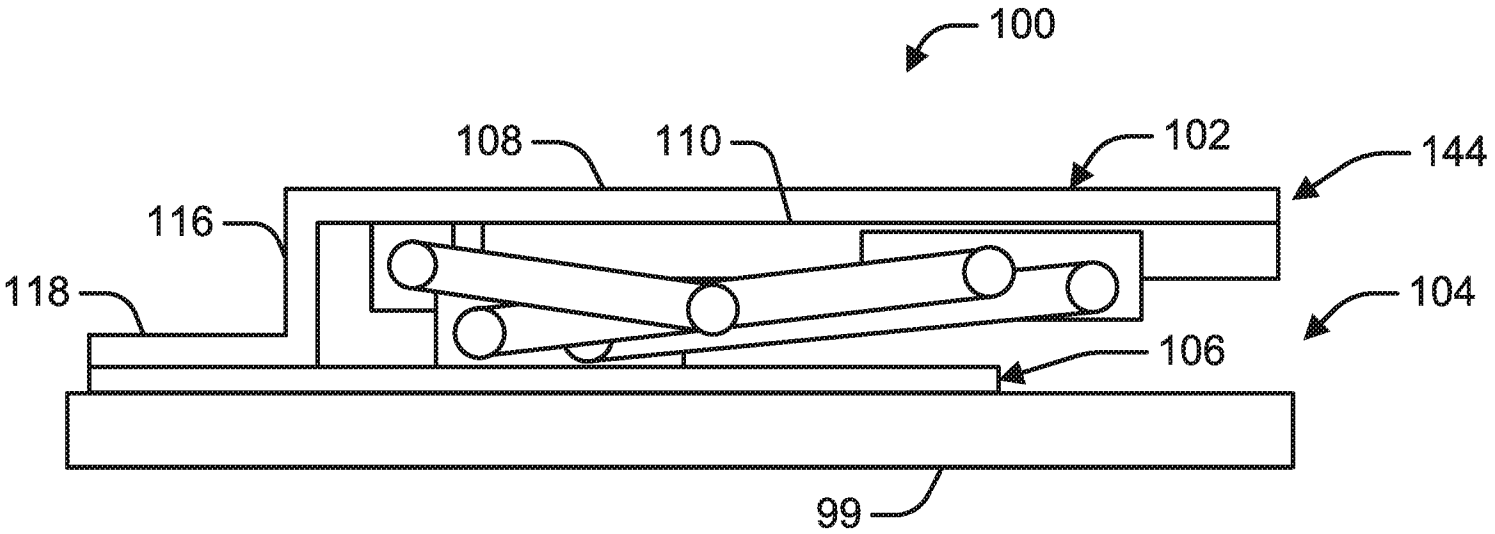
FIG. 7 is a schematic side view of a height adjustable desktop system having a work surface including a shelf positioned in a lowered position, according to an example of the present disclosure.
Figure 8:
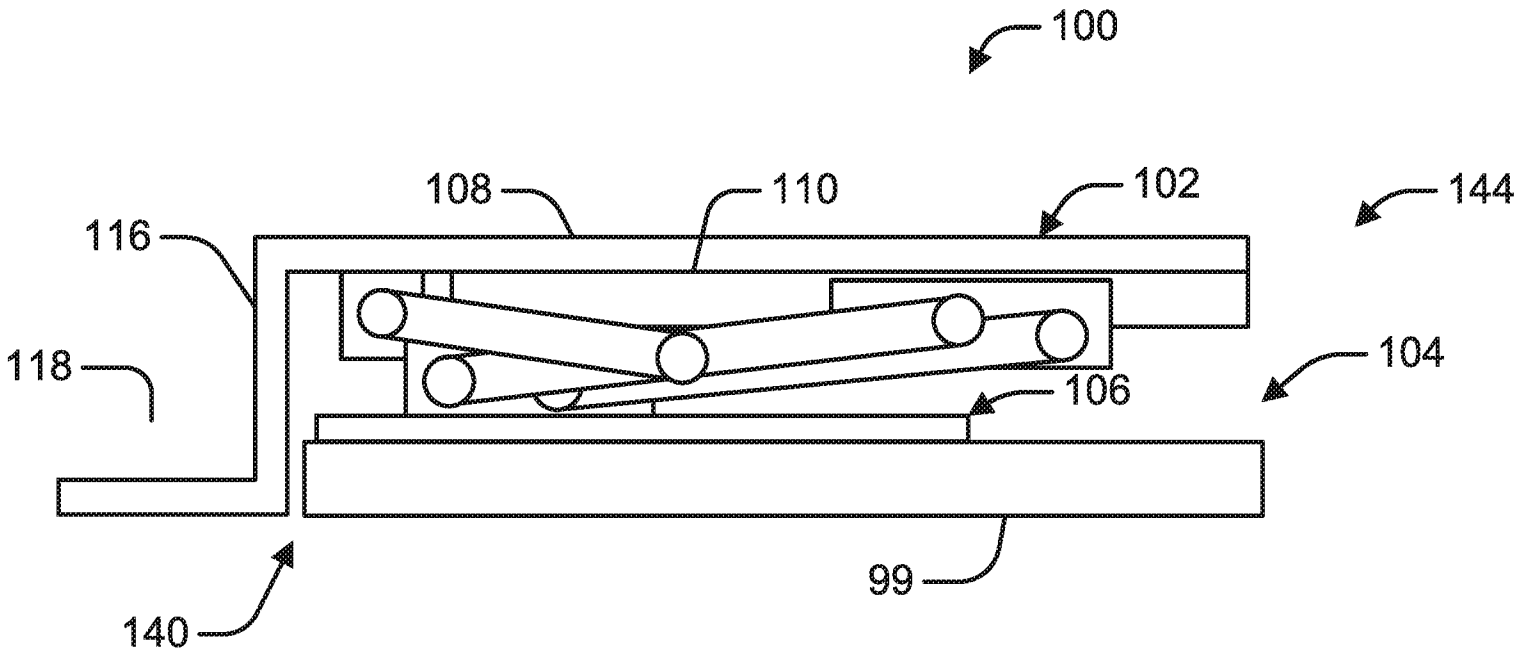
FIG. 8 is a schematic side view of a height adjustable desktop system having a work surface including a shelf positioned in a lowered position, according to an example of the present disclosure.

As depicted in FIGS. 7-8, in an example, the work surface 102 can include a shelf 116 defining a secondary top surface 118 for use as a keyboard tray or other purposes providing a bi-level work surface. In at least one example, the secondary top surface 118 can be located at a lower height than the primary top surface 108. In this configuration, the lower secondary top surface 118 can permit use of certain peripherals at a lower height relative to the primary top surface 108 to position the peripherals at a more ergonomic operating position for the user's hands while the relatively higher primary top surface 108 positions other peripherals, such as computer monitors, at a more ergonomic viewing position for the user's head and eyes. For example, the peripherals for use on the secondary top surface 118 can include, but not limited to computer monitors, keyboards, mice, speakers, boon microphones and other peripherals commonly used with computers. As depicted in FIG. 7, in an example, the secondary top surface 118 can rest against the foot assembly 106 on the desktop 99 in the lowered position 144. As depicted in FIG. 8, in an example, the secondary top surface 118 can extend forward of the front 140 of the desktop 99 and can include a lowered position 144 that can be lower than the surface of the foot assembly 106 or the surface of the desktop 99. In this configuration, the secondary top surface 118 can be positioned at a height about or below the primary top surface 108. As depicted in FIGS. 18-22 and 30, in at least one example, the work surface 102 can include at least one attachment bracket 119 for releasably securing the shelf 116 to the work surface 102. As depicted in FIG. 5, in at least one example, As depicted in FIGS. 5-6, in at least one example, the work surface 102 can include a first glide support 112*a* and a first support bracket 114*a* arranged on the underside 110 of the work surface 102 along a first axis. In this configuration, the work surface 102 also can include a second glide support 112*b* and a second support bracket 114*b* arranged on the underside 110 of the work surface 102 along a second axis parallel to the first axis. In this configuration, the first support bracket 114*a* and the second support bracket 114*b* cooperate to support the work surface 102. In at least one example, the work surface 102 further can include a back bracket 115 joining the first and second glide supports 112*a*, 112*b*.

As depicted in FIGS. 5-6, the linkage assembly 104 can include a first adjustment assembly 120*a* and a second adjustment assembly 120*b*. Whether the linkage assembly 104 includes only one adjustment assembly or additional adjustment assemblies, the following description may use the "first adjustment assembly" nomenclature and element numbering in various examples. The work surface 102 can include a first glide support 112*a* and a first support bracket 114*a* arranged on the underside 110 of the work surface 102 along a first axis. Each adjustment assembly 120*a*, 120*b* can include a first parallel linkage 122, a second parallel linkage 124 and a transverse linkage 126. Each adjustment assembly 120*a*, 120*b* also can include a glider 128 configured to slide on one of the glide supports 112*a*, 112*b*. The first adjustment assembly 120*a* can be located proximate to a first edge 145*a* of the work surface 102. The second adjustment assembly 120*b* can be located proximate to a second edge 145*b* of the work surface 102 which can be opposite the first edge 145*a*. The first and second adjustment assemblies 120*a*, 120*b* can be operationally connected to the work surface 102 on the upper end, such as at the underside 110, and operationally connected to the foot assembly 106 at the lower end. The foot assembly 106 can include an individual foot portion 132 for each adjustment assembly 120*a*, 120*b* as illustrated in FIG. 5, or in some configurations, the foot assembly 106 can be formed as a base 147 that spans from the first adjustment assembly 120*a* to the second adjustment assembly 120*b* as illustrated in FIG. 6.

A first lower bar 130*a* can be formed as part of the foot assembly 106. The first lower bar 130*a* can extend upwardly from the foot assembly 106 and can be formed separately or integrally with the foot assembly 106. The first lower bar 130*a* can be an attachment structure, a bracket, a foot bracket, or similar structure. Similarly, the second adjustment assembly 120*b* can include a second lower bar 130*b* such that the first and second parallel linkages 122, 124 of the second adjustment assembly 120*b* can be individually mounted to the foot portion 132.

As depicted in FIG. 1, the first and second parallel linkages 122, 124 can be rotatably mounted at one end to the first lower bar 130*a* at a first hinge 148 and a second hinge 149 such that the first and second parallel linkages 122, 124 rotate in parallel on the first lower bar 130*a*. The first and second parallel linkages 122, 124 can be rotatably mounted at an opposite end to the glider 128 at a third hinge 150 and a fourth hinge 151 such that the first and second parallel linkages 122, 124 rotate in parallel on the glider 128. Similarly, the transverse linkage 126 can be rotatably mounted at one end to the second parallel linkage 124 by a sixth hinge 153 and rotatably mounted to the corresponding support brackets 114*a*, 114*b* through a fifth hinge 152. In an example, the transverse linkage 126 can be rotatably mounted to the second parallel linkage 124 at about the midpoint of the second parallel linkage 124. In an example, the transverse linkage 126 is about half the length of the second parallel linkage 124.

Figure 30:
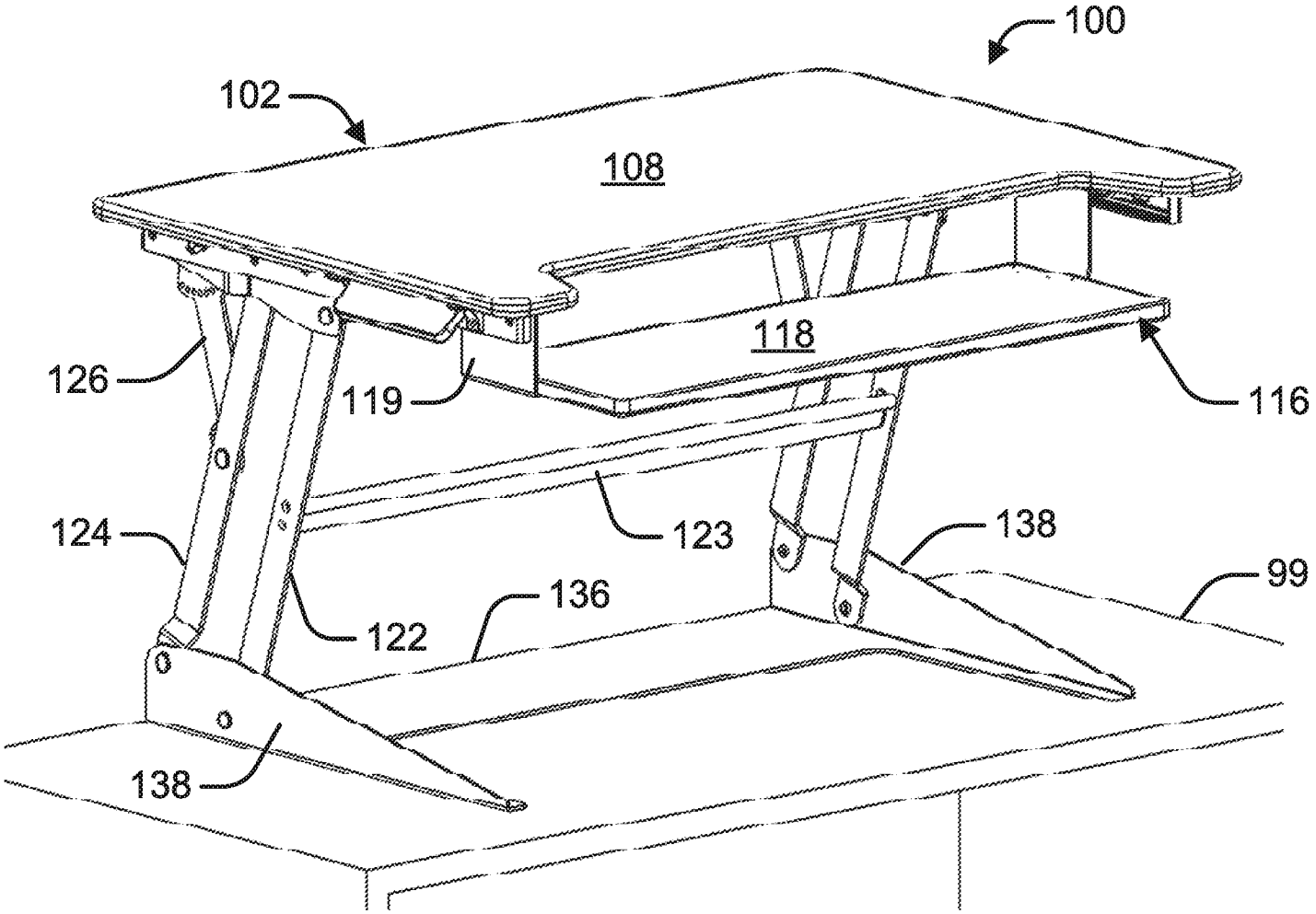
FIG. 30 is a perspective view of a height adjustable desktop system having a work surface in an elevated position, according to an example of the present disclosure.
Figure 33:
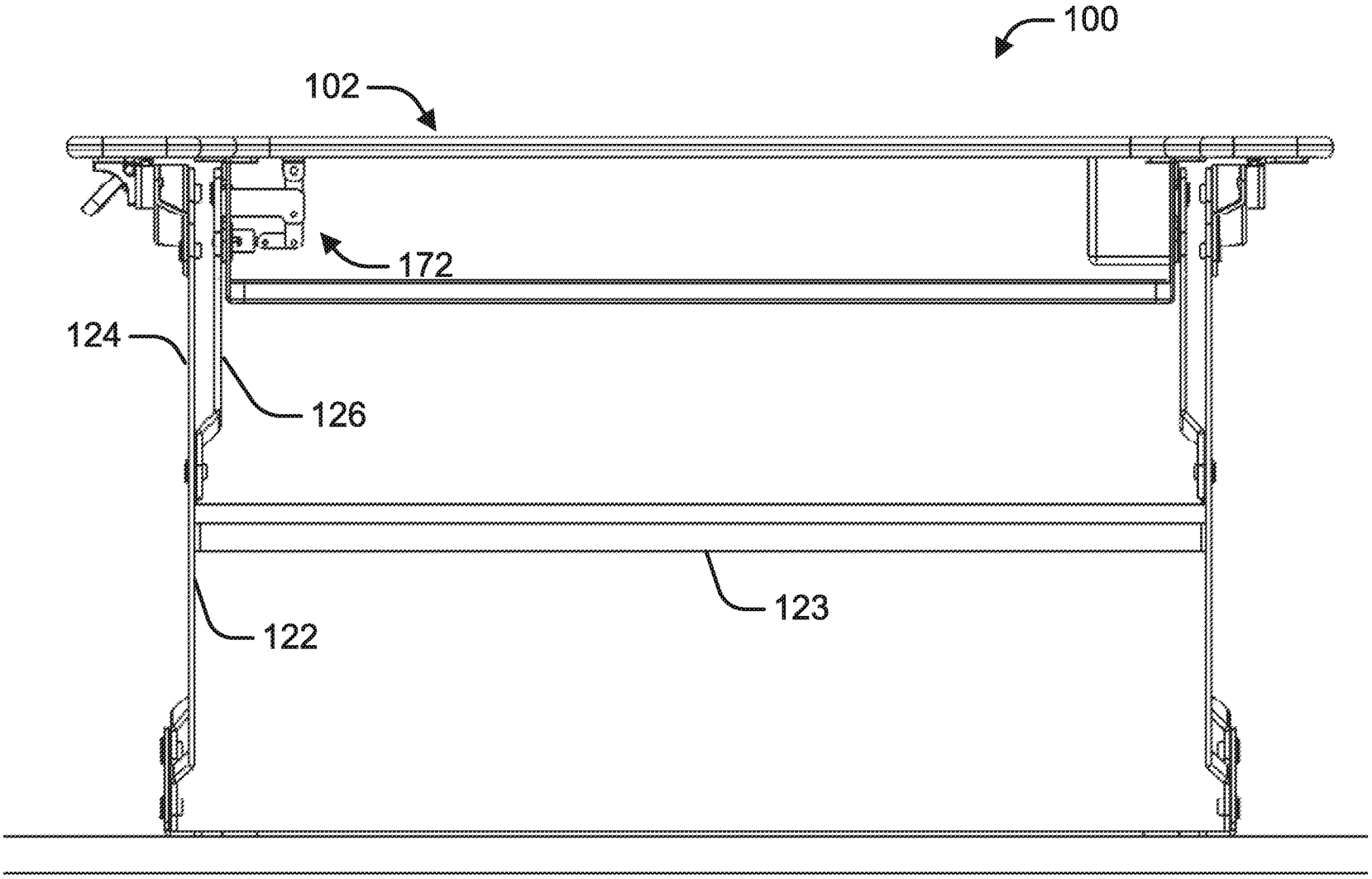
FIG. 33 is a front view of the height adjustable desktop system having a work surface depicted in FIG. 24 of the present disclosure.

As depicted in FIGS. 30 and 33, in an example, the first parallel linkages 122 of the adjustment assemblies 120*a*, 120*b* can be connected by a first cross-piece 123. Similarly, the second parallel linkages 124 of the adjustment assemblies 120*a*, 120*b* can be connected by a second cross-piece 125.

As depicted in FIGS. 4-6, in an example, the first and second parallel linkages 122, 124, the transverse linkage 126 and combinations thereof can be offset along an axis transverse to plane of rotation of the first and second parallel linkages 122, 124 and the transverse linkage 126. In this configuration, the offset prevents contact or pinching of the linkages 122, 124, and 126 during rotation of the linkages 122, 124, and 126. As illustrated in FIG. 4, in at least one example, the first parallel linkage 122 can rotate in a first plane and the second parallel linkage 124 can rotate in a second plane. The second plane can be parallel to and offset from the first plane. The offsetting of the first and second planes can prevent torqueing of the work surface 108 relative to the foot assembly 147 during use of the work surface 108.

FIGS. 1-3 illustrate side views of a height adjustable desktop system 100 and a linkage assembly 104. FIG. 1 illustrates an elevated position 142, FIG. 2 illustrates an intermediate position 143 and FIG. 3 illustrates a lowered position 144. As depicted in FIGS. 1-3, the linkage assembly 104 can be configured with a 4-bar linkage 105 to keep the platform in horizontal orientation during the height adjustment.

FIGS. 1-3 illustrate the operation of the height adjustable desktop system 100. In operation, the gliders 128 of the first and second adjustment assemblies 120*a*, 120*b* can each slide along the corresponding first and second glide support 112*a*, 112*b* between a first position 138 and a second position 139, which correspondingly moves the work surface 102 between an elevated position 142 and a lowered position 144, FIG. 2 illustrates the work surface 102 in an intermediate position 143 as the first glide support 112*a* is between a first position 138 and a second position 139. In the first position 138, each glider 128 can be positioned proximate to the corresponding support bracket 114*a*, 114*b* along the corresponding first and second glide support 112*a*, 112*b* such that the work surface 102 can be raised to an elevated position 142 (see FIG. 1). In the elevated position 142, the first, second and transverse linkages 122, 124, 126, can be extended when the glider 128 is positioned in the first position 138. In the second position 139, each glider 128 can be located distal to the corresponding support bracket 114*a* along the corresponding first and second glide support 112*a*, 112*b* such that the work surface 102 can be located in a lowered position 144 (see FIG. 3). As the work surface 102 moves from elevated position 142 to lowered position 144 by means of the linkage assembly 104, parallel linkages 122 and 124 can maintain the horizontal orientation of the work surface 102, and the transverse linkage 126 can maintain the vertical orientation of the work surface 102. The first parallel linkage 122, the second parallel linkage 124 and the transverse linkage 126 can be collapsed toward the foot assembly 106 when the glider 128 is positioned in the second position 139. When the glider 128 reaches the second position, the work surface 102 can be at the lowered position 144.

The height adjustable desktop system 100 can also be configured with a work surface 102 that is angled, such as a drafting table. The linkage assembly 104 can be configured to maintain the angle of the work surface 102 relative to the foot assembly 106 during a height adjustment.

Figure 9:
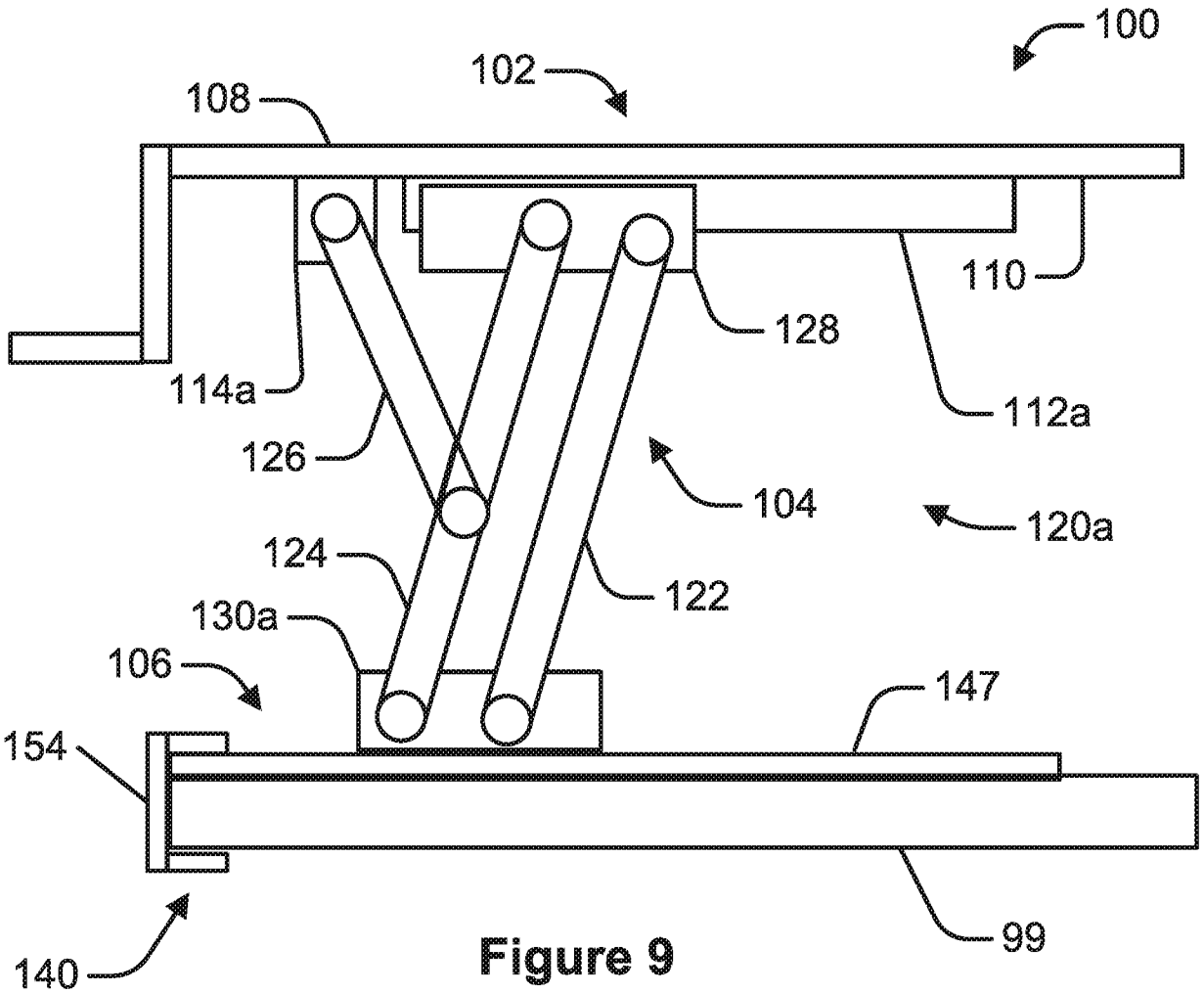
FIG. 9 is a schematic side view of a height adjustable desktop system having a clamping member, according to an example of the present disclosure.
Figure 10:
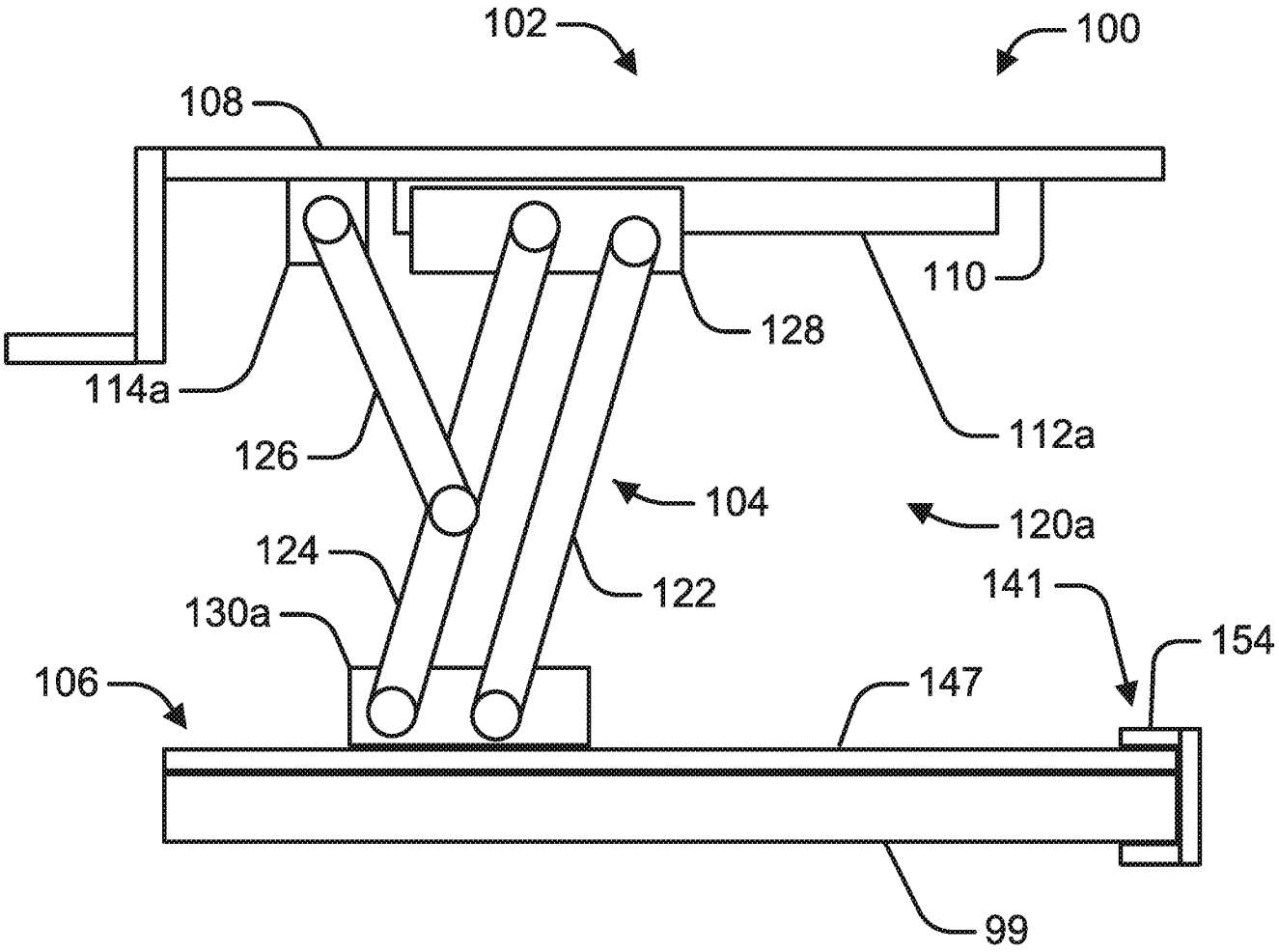
FIG. 10 is a schematic side view of a height adjustable desktop system having a clamping member, according to an example of the present disclosure.
Figure 11:
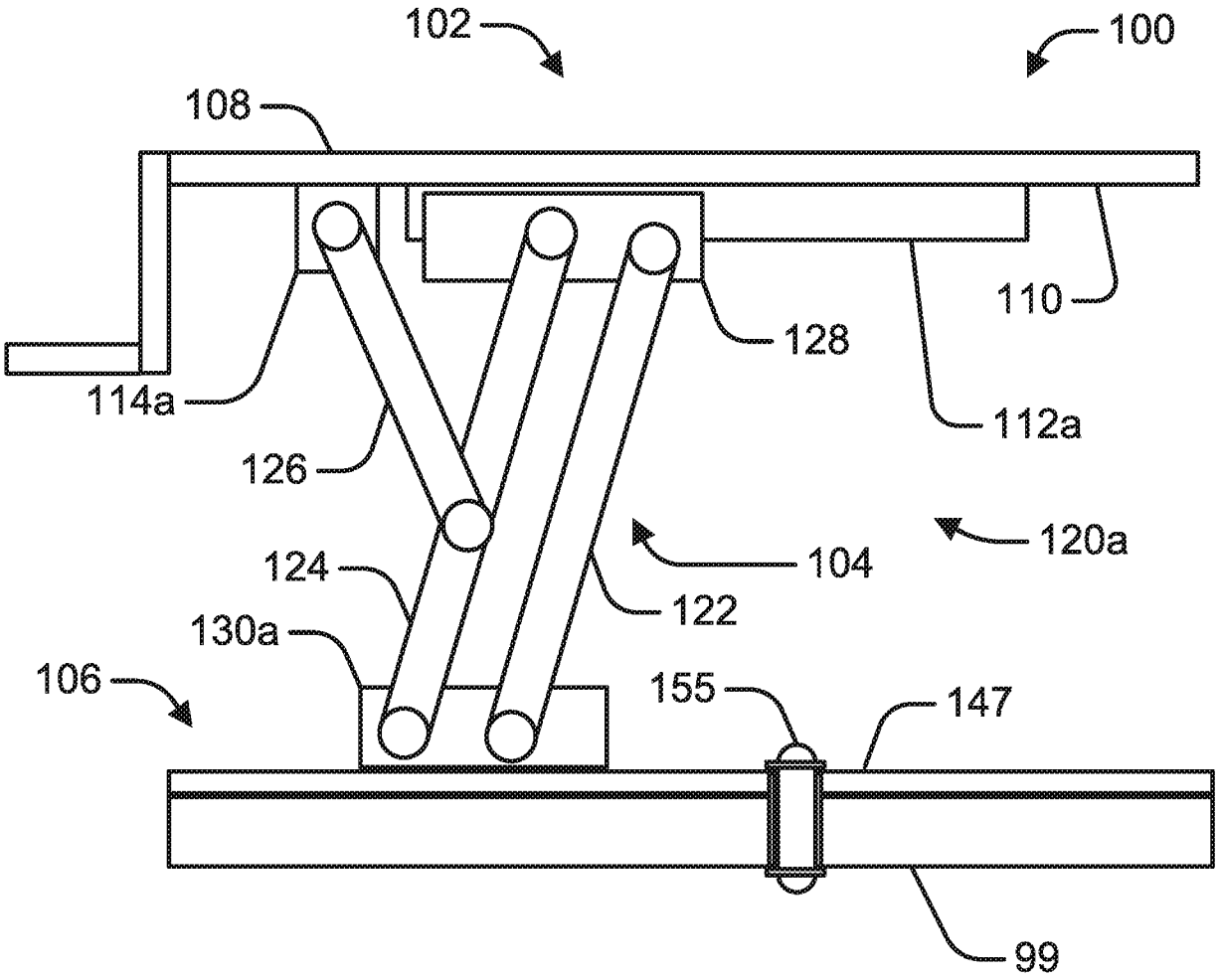
FIG. 11 is a schematic side view of a height adjustable desktop system having a work surface in an elevated position, according to an example of the present disclosure.

The height adjustable desktop system 100 can be used as free standing on the top of a desktop 99 as illustrated in FIGS. 1-8. However, in some configurations, the base 147 or foot assembly 106 of the work surface 102 can be secured to the desktop 99 as illustrated in FIGS. 9-11. The securement can be accomplished by a clamping member such as a clamp, a grommet, a vise, a cramp, a dog, a clip, or an alternative type of fastener. In some configurations, one or more clamping members 154 can be located in front 140 of the base 147 as illustrated in FIG. 9. In other configurations, one or more clamping members 154 can be located at the rear 141 of the base 147 as illustrated in FIG. 10. Clamping members 154 can be located on any edge of the base 147 and in any number desired. Still in other configurations, a grommet mount 155 can be used to attach the base 147 to the desktop 99 as illustrated in FIG. 11. The grommet mount 155 can allow the height adjustable desktop system 100 to be rotated to the right or left. The grommet mount 155 can be located at the center of the base 147 or at other locations of the base 147. The grommet mount 155 can form a rotation center of the base 147. Multiple grommet mounts 155 can also be used. Various clamping devices are disclosed as part of the patent application Ser. No. 13/191,170, published as 2012/0187056 which is hereby incorporated by reference herein in its entirety. Clamping the base 147 of the height adjustable desktop system 100 to the desktop 99 can improve the stability of the work surface 102 during uses such as typing.

Figure 12:
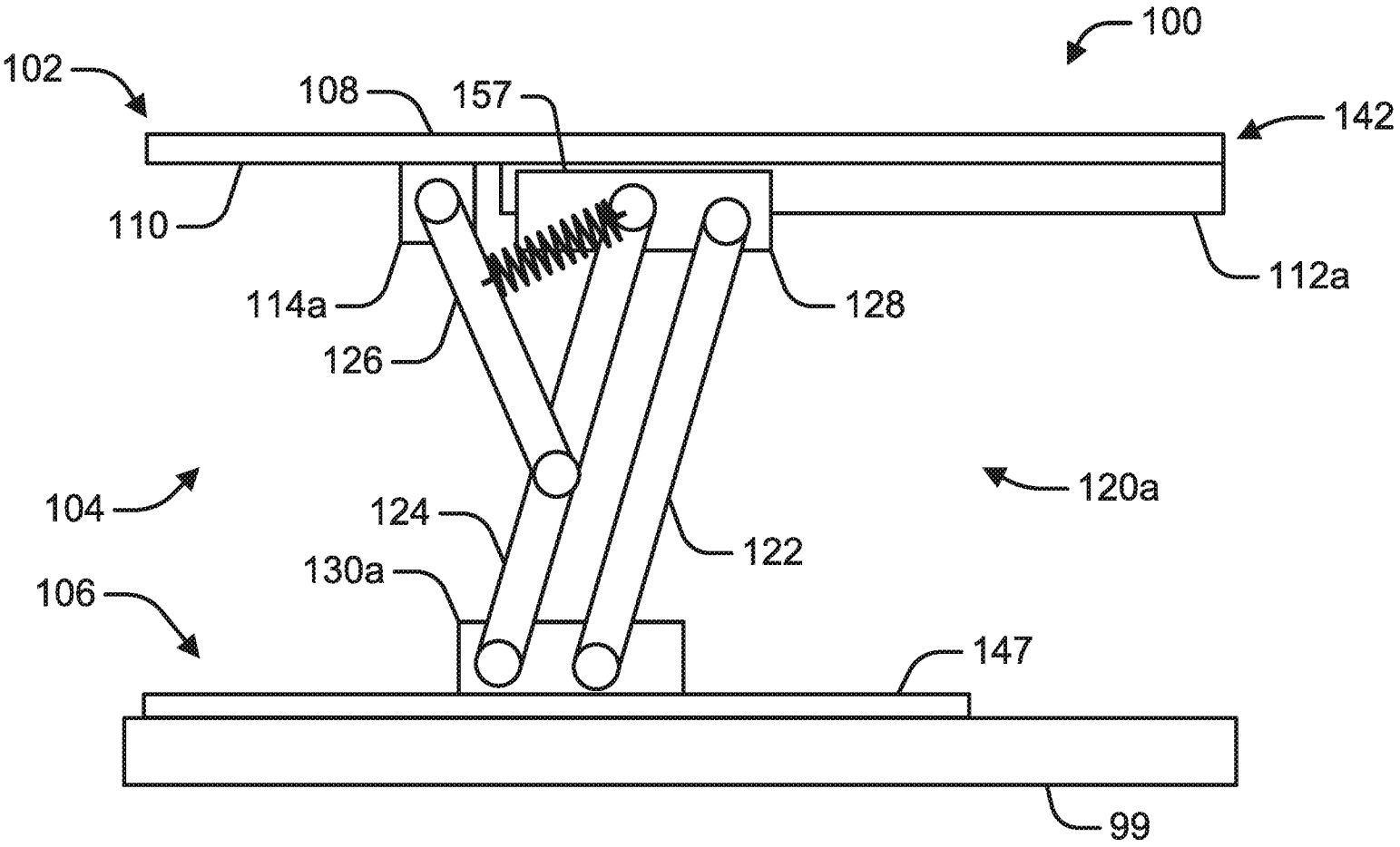
FIG. 12 is a schematic side view of a height adjustable desktop system having a work surface in an elevated position, according to an example of the present disclosure, wherein an extension spring operably linking a glider to a transverse linkage.
Figure 13:
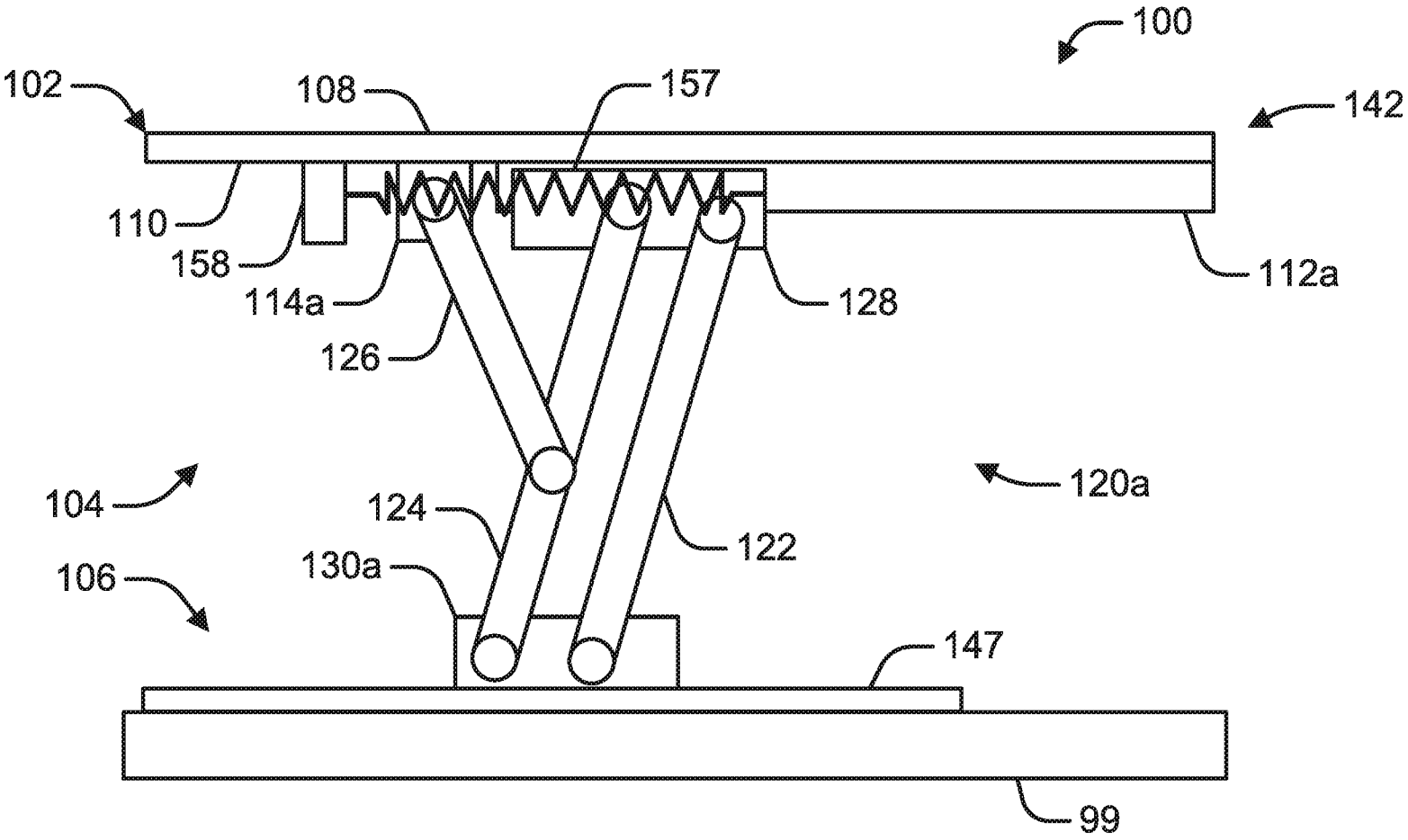
FIG. 13 is a schematic side view of a height adjustable desktop system having a work surface in an elevated position, according to an example of the present disclosure, wherein an extension spring operably linking a glider to a spring holding bracket affixed to the work surface.
Figure 14:
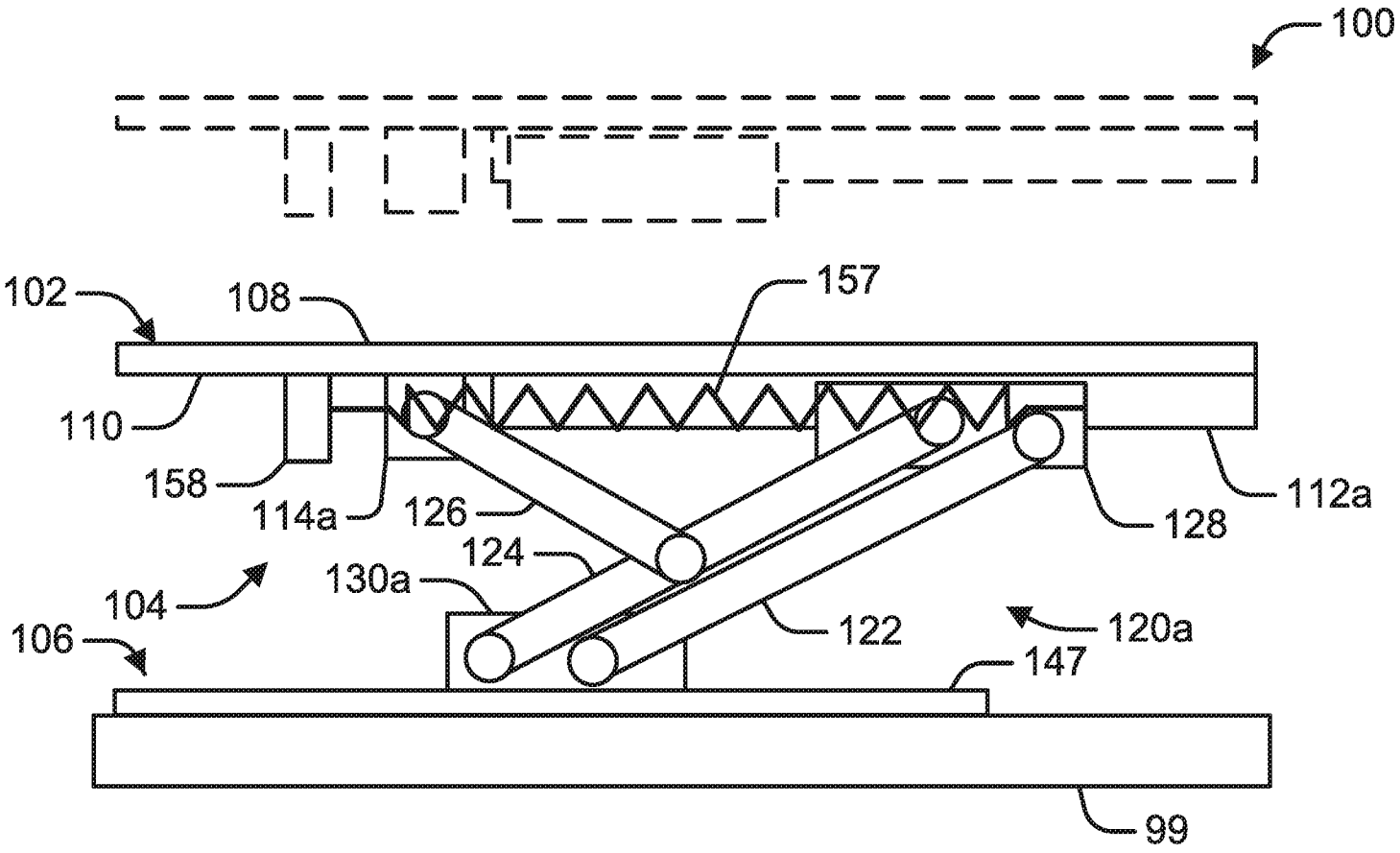
FIG. 14 is a schematic side view of the height adjustable desktop system depicted in FIG. 7 having a work surface positioned in an intermediate lowered position, according to an example of the present disclosure.

A counterbalance mechanism can be used for lift assist during the height adjustment to reduce the force exerted by the user. As depicted in FIGS. 12-14, in an example, each adjustment assembly 120*a*, 120*b* can include a counterbalance mechanism such as an extension spring 157. The extension spring 157 can operably connect the glider 128 to the corresponding transverse linkage 126 as depicted in FIG. 12. As the work surface 102 is lowered and the glider 128 moves away from the corresponding support bracket 114*a*, 114*b*, the extension spring 157 can be stretched (see FIG. 14) to bias the work surface 102 toward the elevated position 142 (see FIGS. 12-13). In certain examples, the work surface 102 can further include a spring holding bracket 158 located on the underside 110 of the work surface 102. FIGS. 13-14 illustrate the extension spring 157 can be operably connected to the spring holding bracket 158 rather than the transverse linkage 126 as depicted in FIG. 12.

Figure 15:
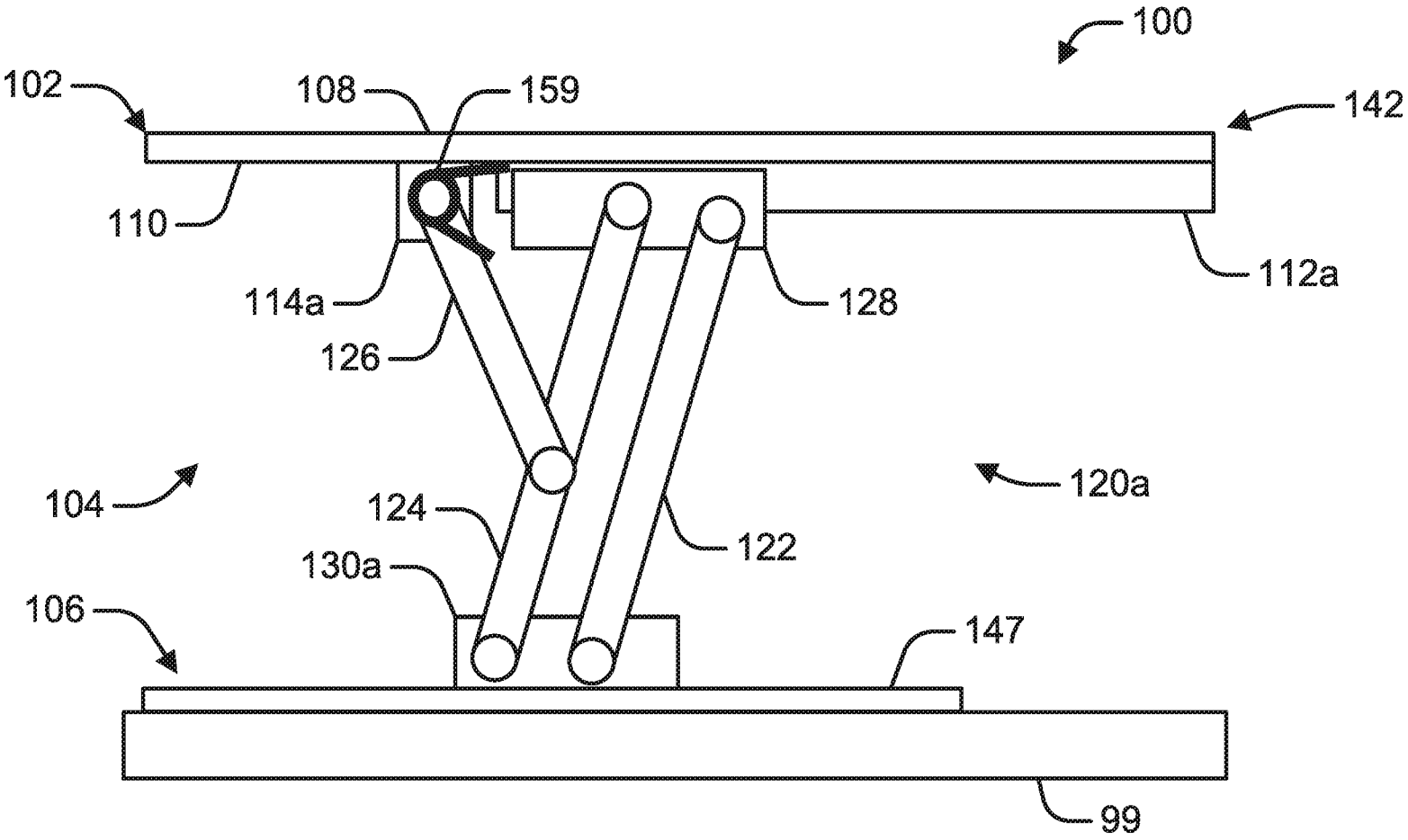
FIG. 15 is a schematic side view of a height adjustable desktop system having a work surface in an elevated position, according to an example of the present disclosure, wherein a torsion spring is positioned bias the work surface to the elevated position.
Figure 16:
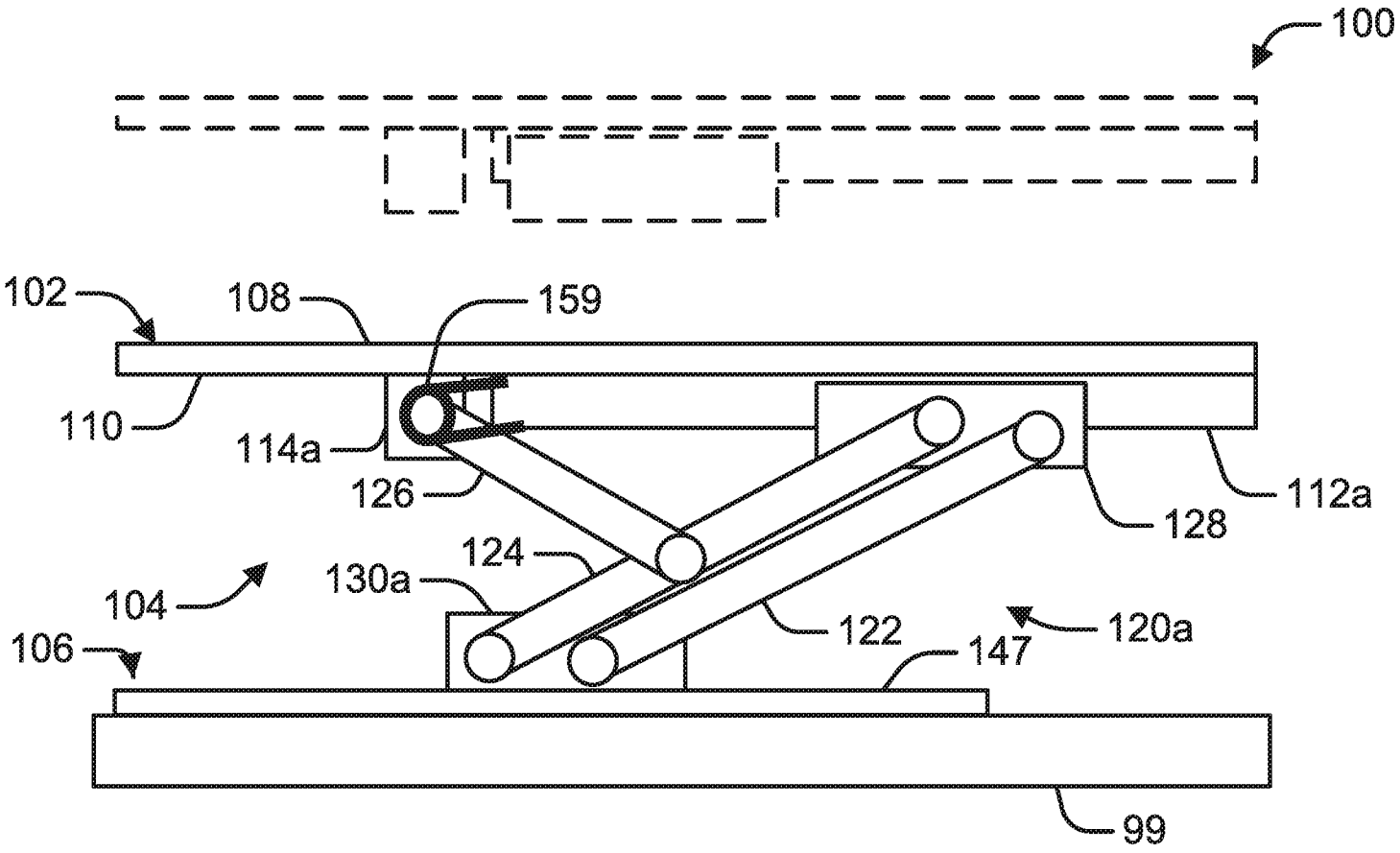
FIG. 16 is a schematic side view of the height adjustable desktop system depicted in FIG. 15 having a work surface positioned in an intermediate lowered position, according to an example of the present disclosure.

As depicted in FIGS. 15-16, in an example, each adjustment assembly 120*a*, 120*b* can include a counterbalance mechanism such as a torsion spring 159. The torsion spring 159 operably engages the transverse linkage 126 and the underside 110 of the work surface 102. As the work surface 102 is lowered and the transverse linkage 126 collapses (see FIG. 16), the torsion spring 159 is tensioned biasing the work surface 102 toward the elevated position 142 (see FIG. 15).

Figure 17:
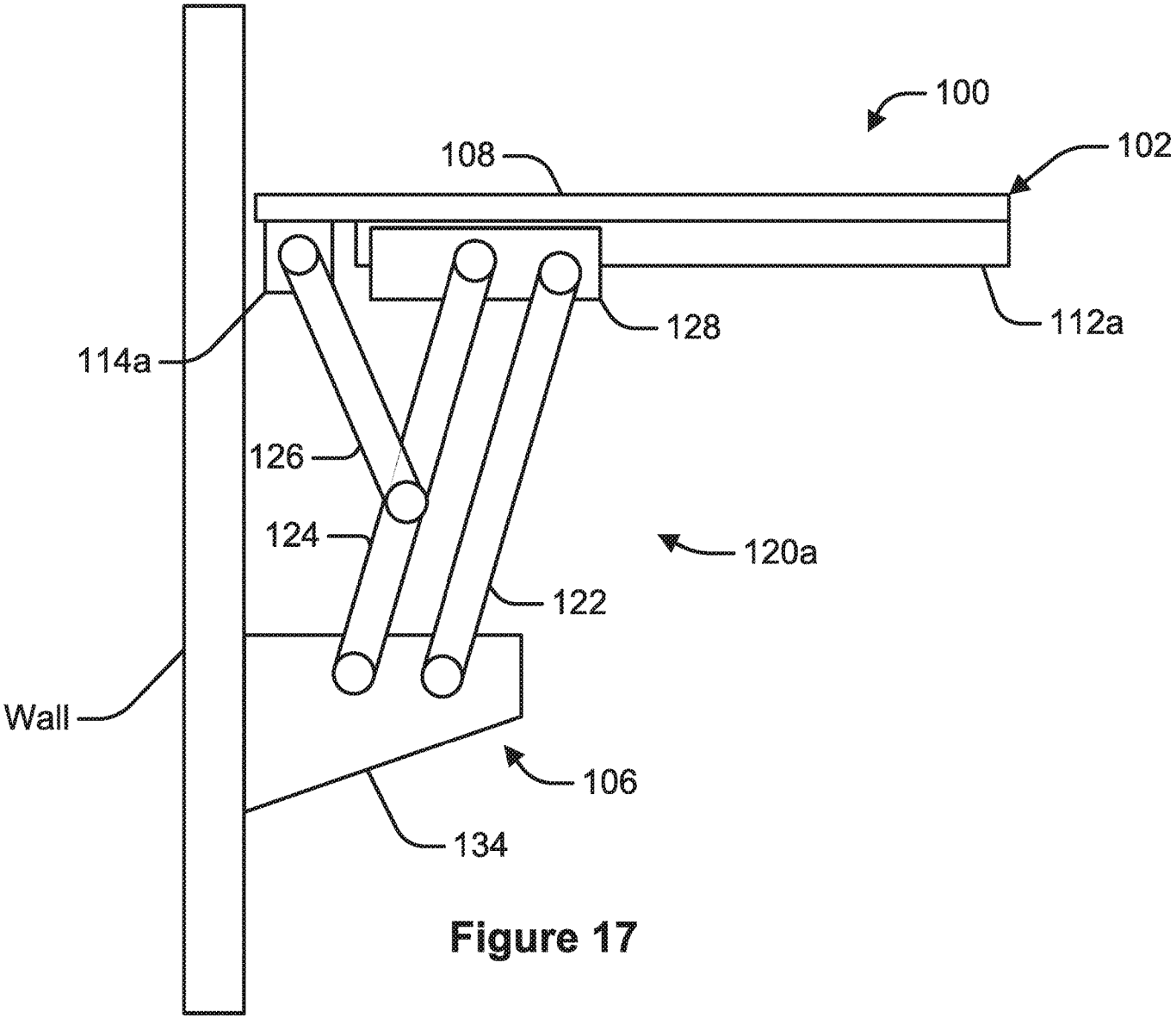
FIG. 17 is a schematic side view of a height adjustable desktop system having a work surface in an elevated position and having a wall bracket for mounting the system to a wall, according to an example of the present disclosure.
Figure 18:
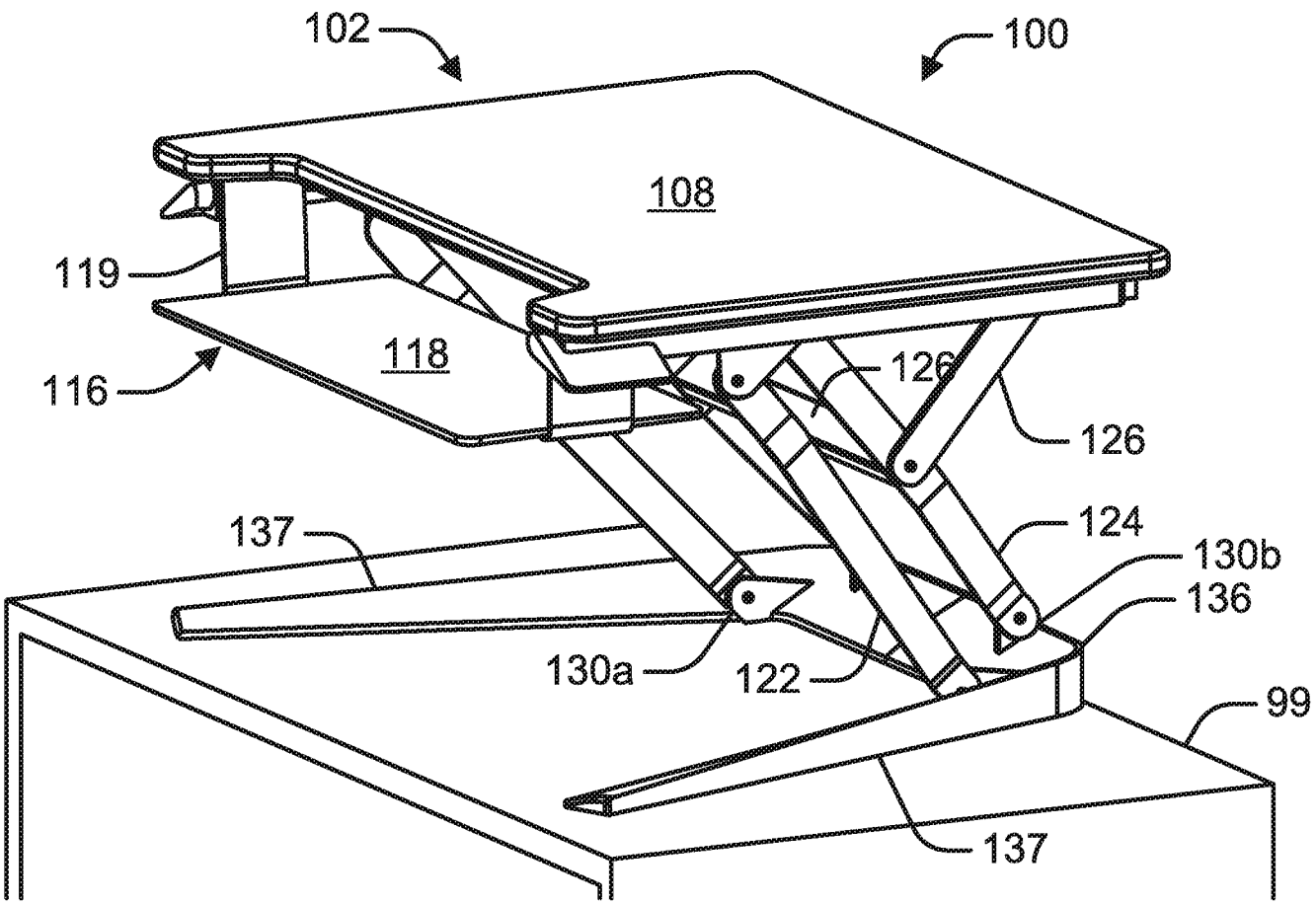
FIG. 18 is a perspective view of a height adjustable desktop system having a work surface in an elevated position, according to an example of the present disclosure.
Figure 19:
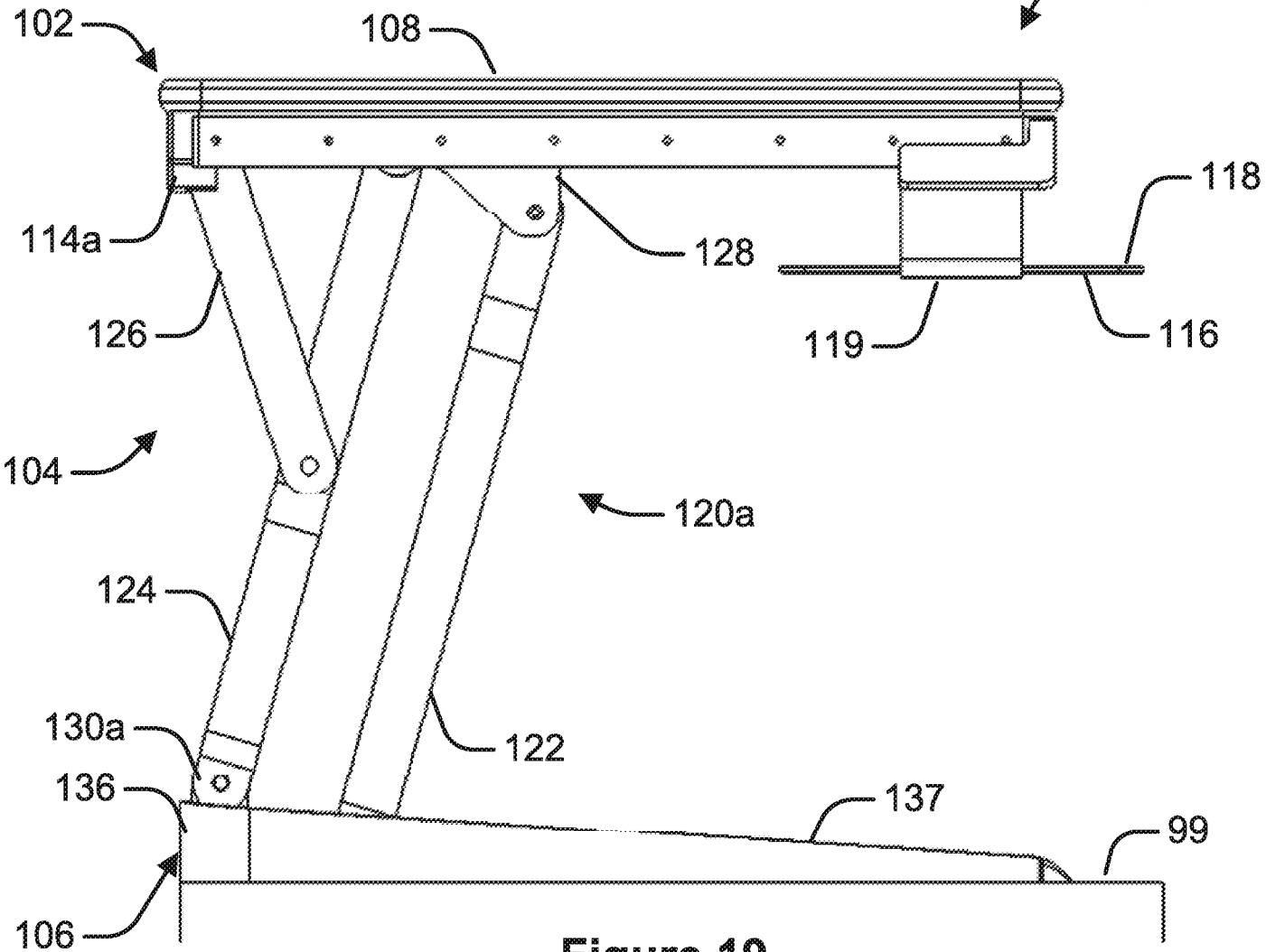
FIG. 19 is a side view of the height adjustable desktop system having a work surface depicted in FIG. 18.
Figure 20:
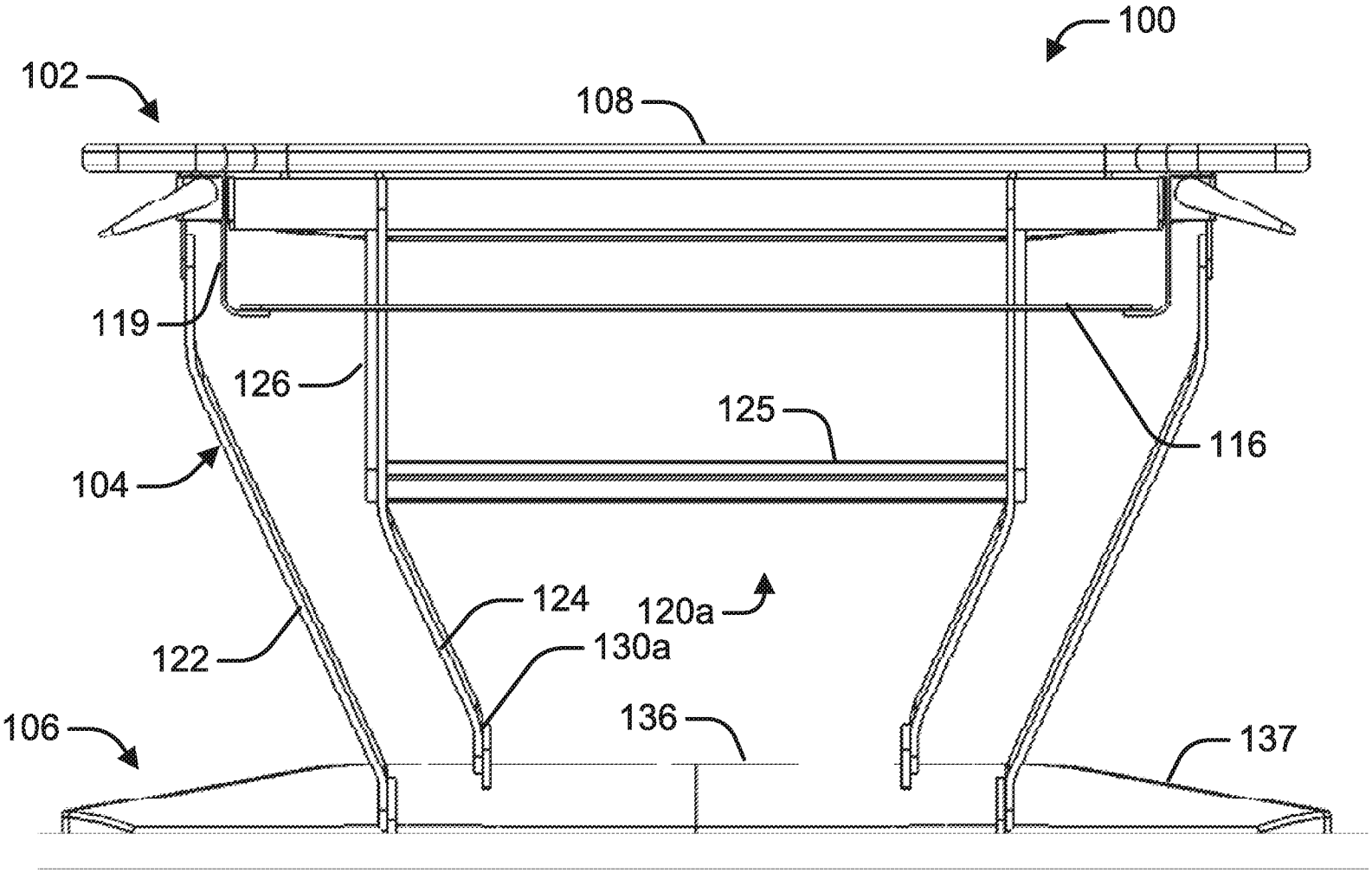
FIG. 20 is a front view of the height adjustable desktop system having a work surface depicted in FIG. 18.
Figure 21:
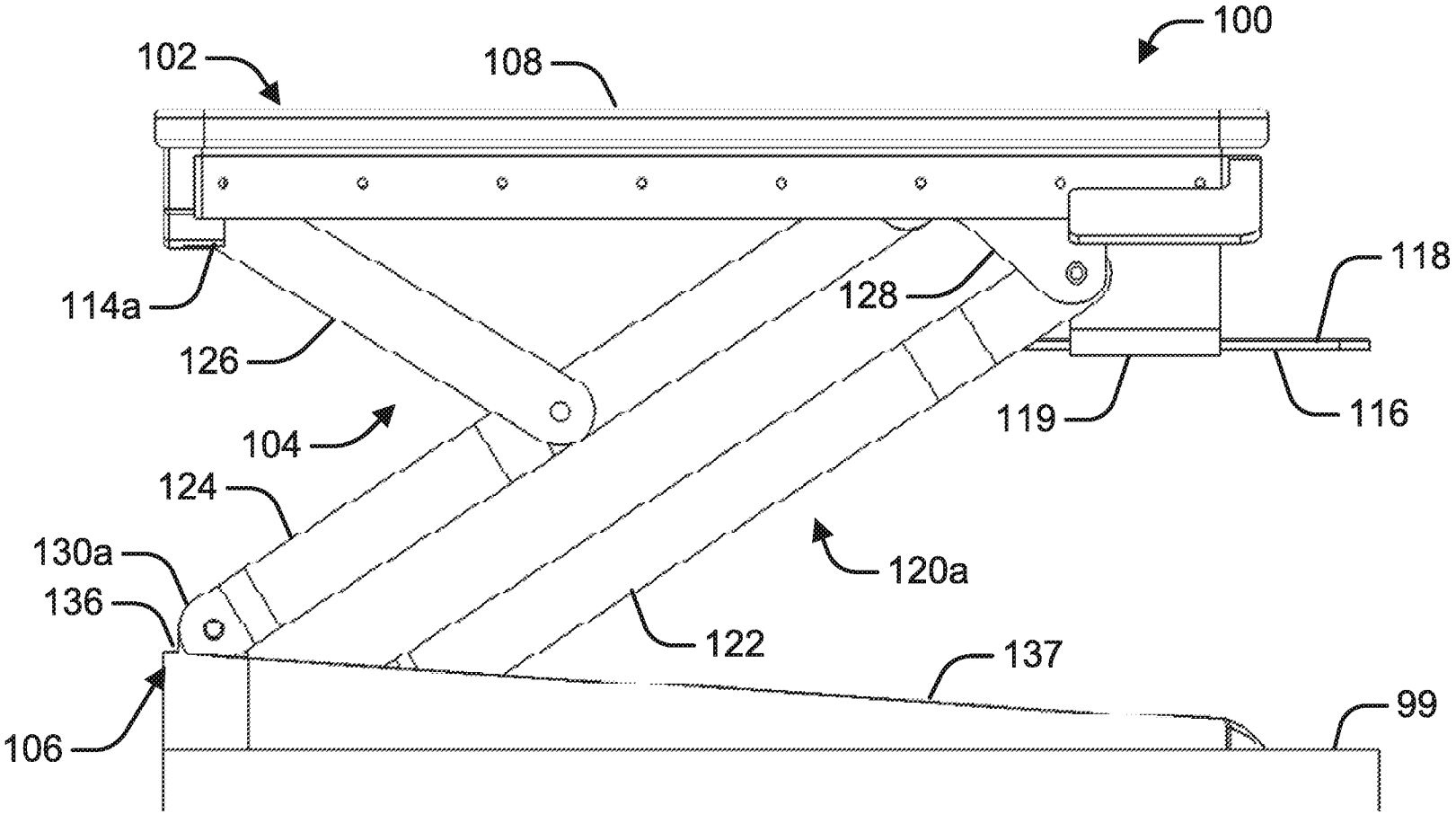
FIG. 21 is a side view of the height adjustable desktop system depicted in FIG. 18 having the work surface positioned in an intermediate lowered position, according to an example of the present disclosure.
Figure 22:
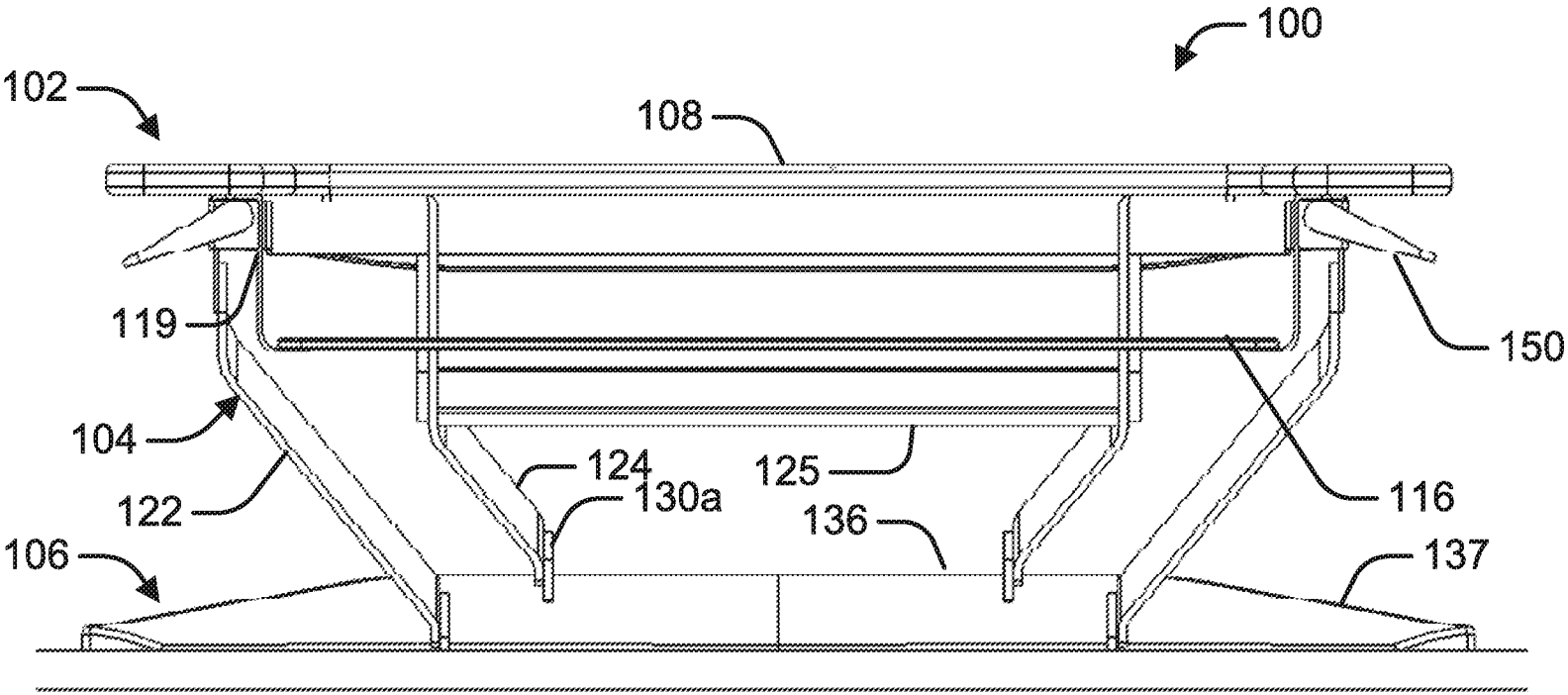
FIG. 22 is a side view of the height adjustable desktop system depicted in FIG. 18 having the work surface positioned in an intermediate lowered position, according to an example of the present disclosure.
Figure 23:
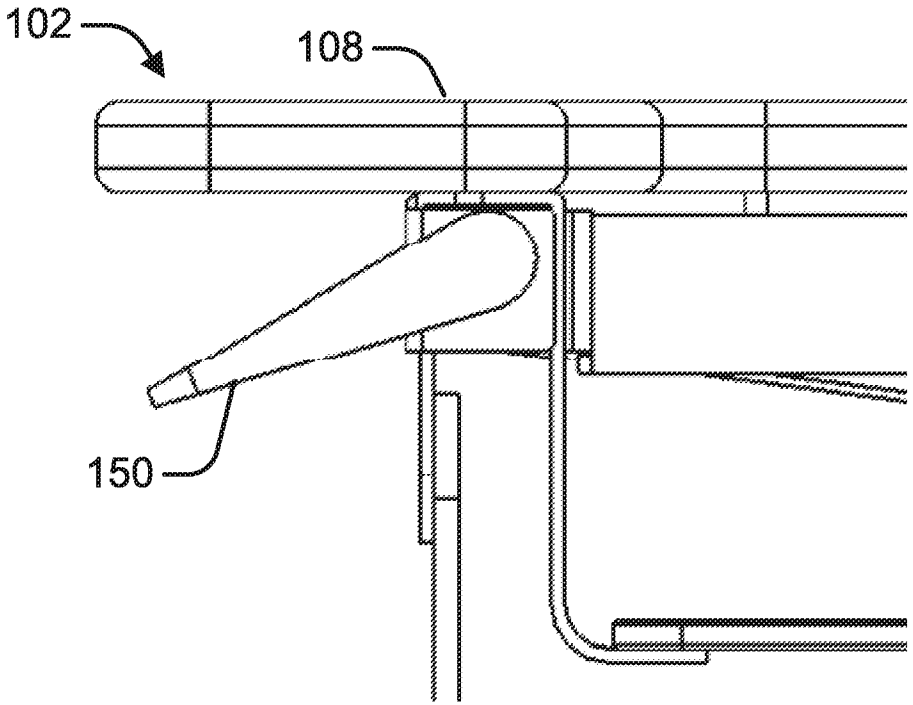
FIG. 23 is partial front view of a height adjustable desktop system illustrating a lever for a glide rod, according to an example of the present disclosure.
Figure 24:
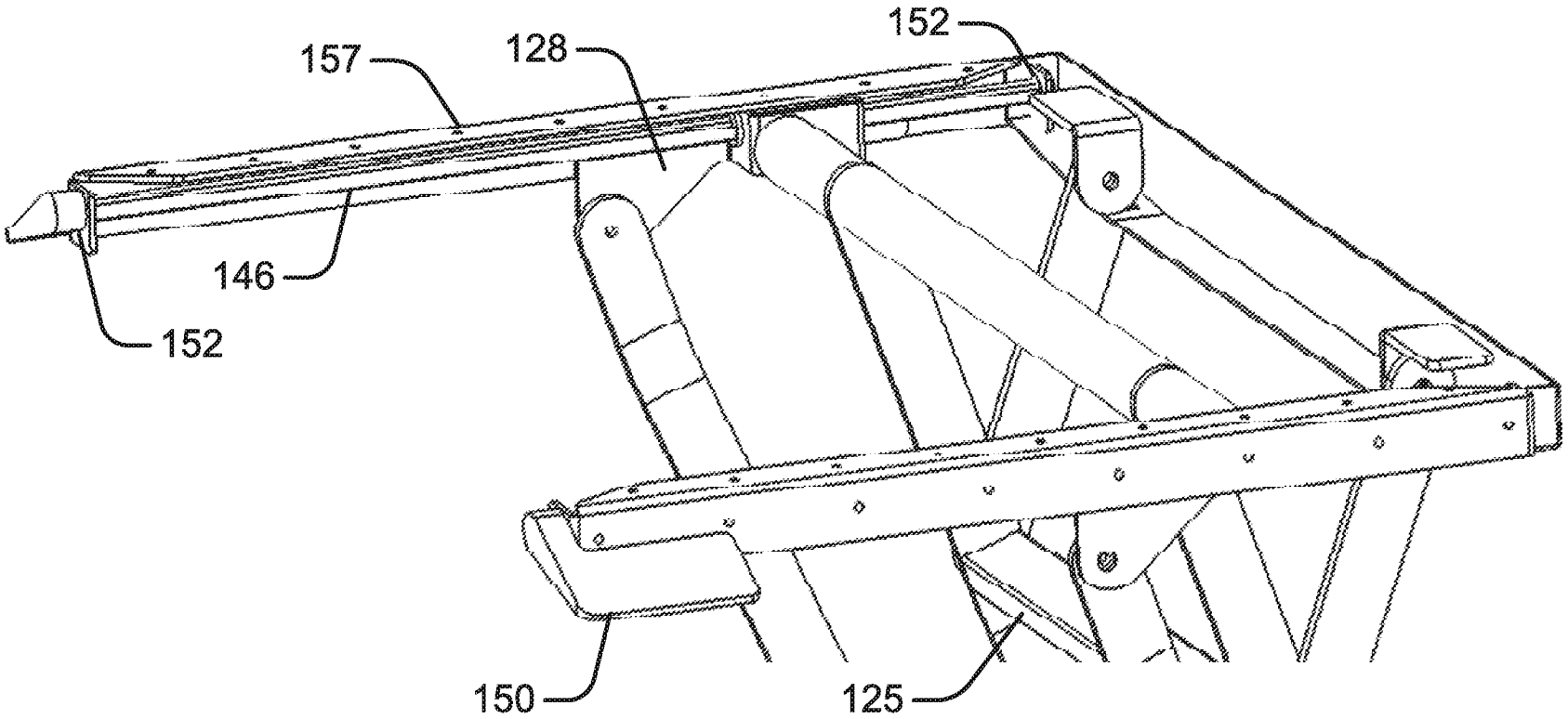
FIG. 24 is a partial perspective view of a height adjustable desktop system, according to an example of the present disclosure.
Figure 25:
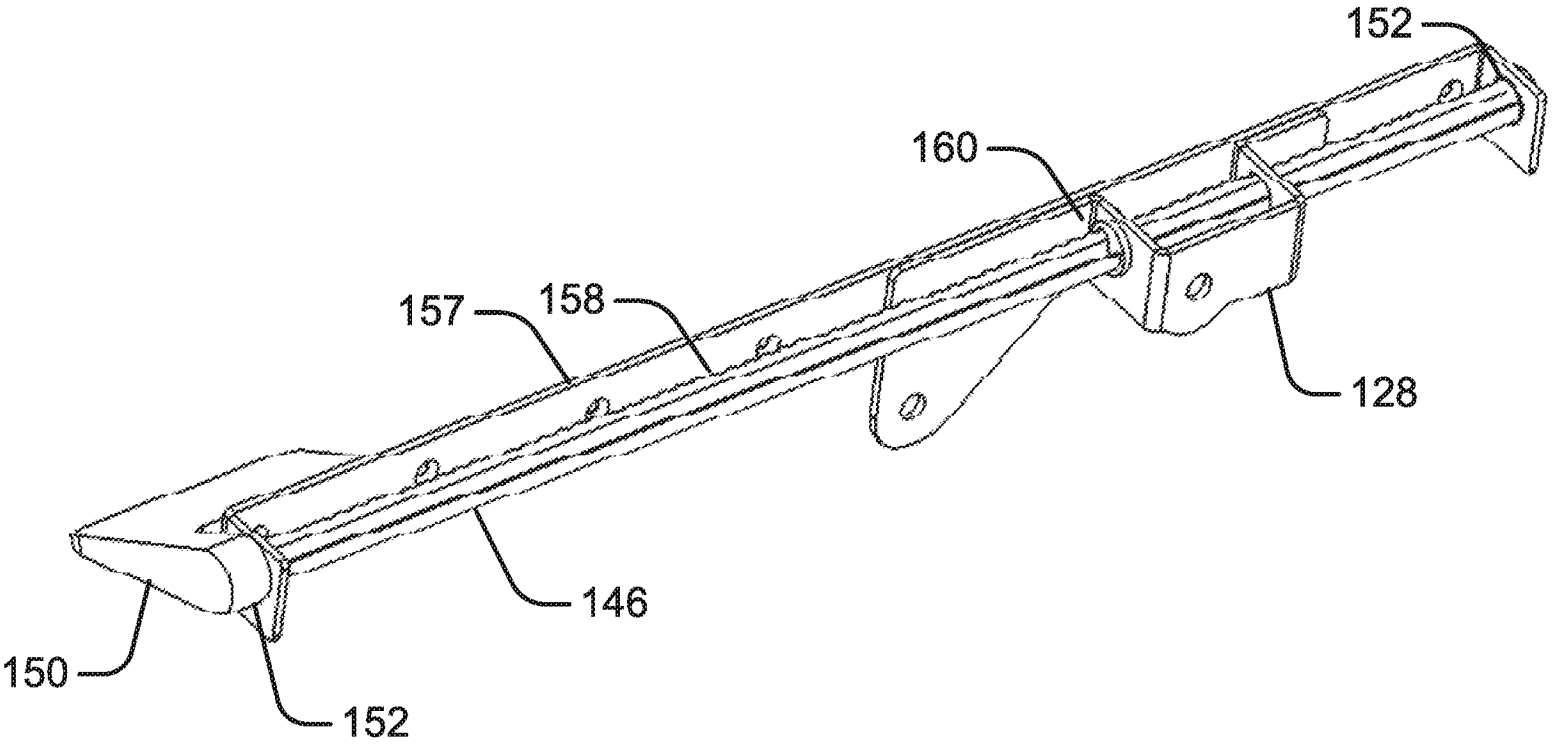
FIG. 25 is a perspective view of a glider rod, support frame and glider assembly, according to an example of the present disclosure.
Figure 26:
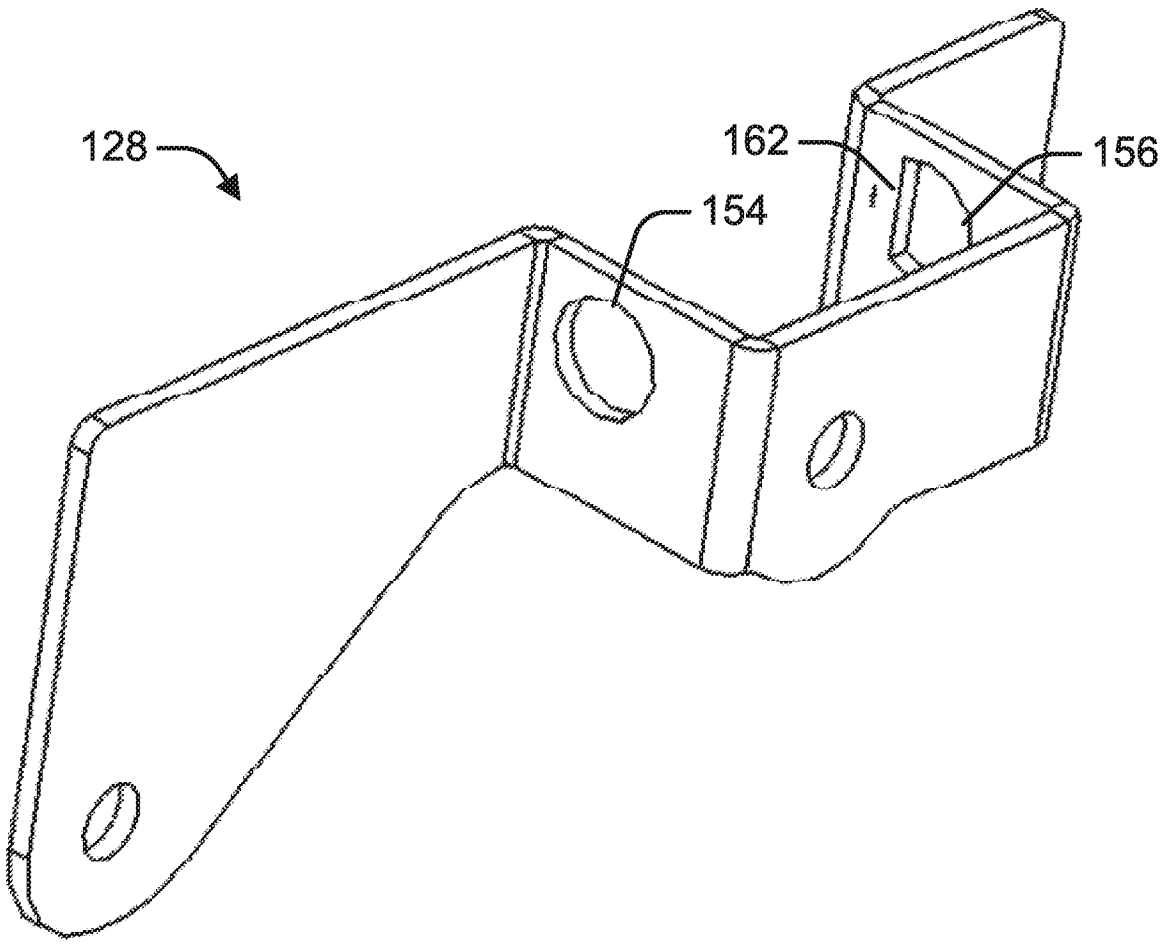
FIG. 26 is a perspective view of a glider, according to an example of the present disclosure.
Figure 27:
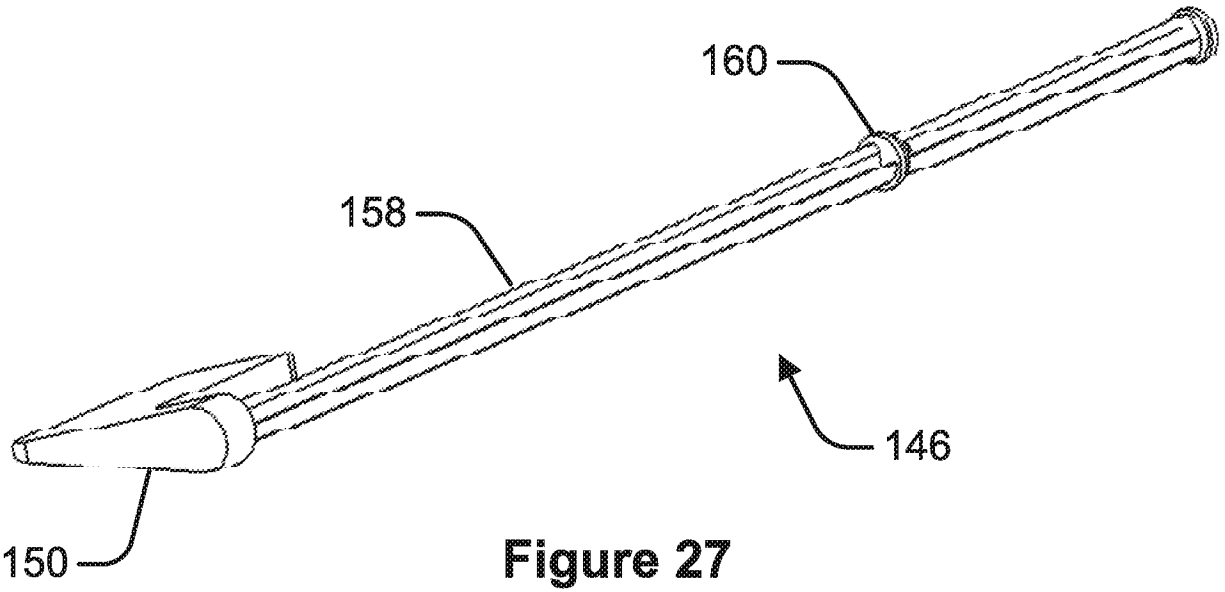
FIG. 27 is a perspective view of a glider rod, according to an example of the present disclosure.
Figure 28:
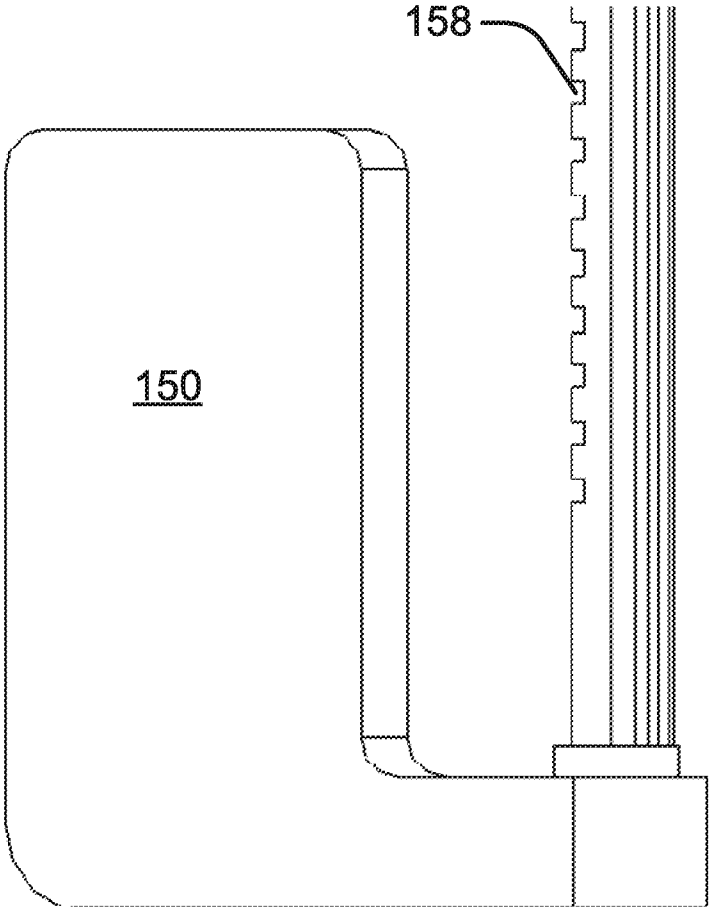
FIG. 28 is a top view of a lever of a glider rod, according to an example of the present disclosure.
Figure 29:
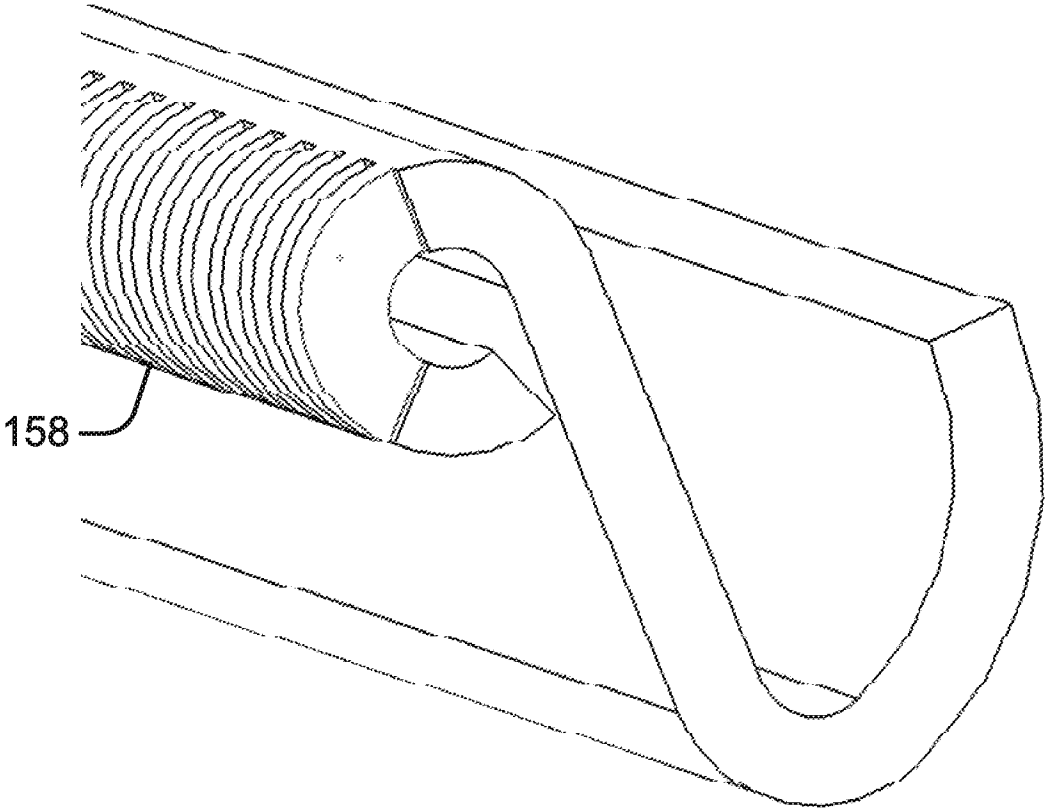
FIG. 29 is a partial cross-sectional view of a glider rod, according to an example of the present disclosure.

As depicted in FIGS. 5-6 and 18, the foot assembly 106 can include a first foot bracket 130*a*, a second foot bracket 130*b* and a foot portion 132. The foot brackets 130*a*, 130*b* can be fixed to the foot portion 132. In this configuration, the first and second parallel linkages 122, 124 of the first adjustment assembly 120*a* can be rotatably mounted to the foot bracket 130*a* through a hinge connection. Similarly, the first and second parallel linkages 122, 124 of the second adjustment assembly 120*b* can be rotatably mounted to the foot bracket 130*b* through a hinge connection. In an example, the foot portion 132 comprises a planar element for interfacing a top surface of a desktop as depicted in FIGS. 1-16. In an example, the foot portion 132 comprises a wall bracket 134 for receiving a fastener for securing the foot assembly 106 to a wall or other vertical surfaces such as depicted in FIG. 17. In at least one example, the wall bracket 134 can be configured to attach to shelf or other mounting bracket attached to the wall. In an example, the foot portion 132 comprises a U-shape element 136 having a pair of arms 137 for stabilizing the foot assembly 106 as depicted in FIGS. 18-22 and 30-33. In at least one example, the foot assembly 106 can include a plurality of first foot brackets 130*a* such that the first and second parallel linkages 122, 124 of the first adjustment assembly 120*a* can be individually mounted to the foot portion 132. Similarly, the second foot assembly 106 can include a plurality of second foot brackets 130*b* such that the first and second parallel linkages 122, 124 of the second adjustment assembly 120*b* can be individually mounted to the foot portion 106.

As depicted in FIGS. 6-8, in an example, each adjustment assembly 120*a*, 120*b* can include a counterbalance mechanism such as an extension spring 157. The extension spring 157 operably connects the glider 128 to the corresponding transverse linkage 126 as depicted in FIG. 6. As the work surface 102 is lowered and the glider 128 moves away from the corresponding support bracket 114*a*, 114*b*, the extension spring 157 is stretched to bias the work surface 102 toward the elevated position.

As depicted in FIGS. 18-29, in an example, each glide support 112*a*, 112*b* can include a glide rod 146 and a support frame 157. The glide rod 146 further can include a lever 150 that can be actuated to rotate the glider rod 146. The support frame 157 defines a pair of opposing bore holes 152 for rotatably receiving the glider rod 146. In this configuration, each glider 128 also can include a first glide hole 154 and a second glide hole 156, wherein the first glide hole 154 is aligned with the second glide hole 156 such that the glider 128 is slidable along the glider rod 146.

As depicted in FIGS. 24-26 and 27-29, in an example, the glider rod 146 defines a plurality of indentations 161, in this configuration, the first glide hole 154 of the glider 128 comprises a circular shape and is configured to receive a bushing 160 allowing the glide rod 146 to slide through the first glide hole 154 regardless of the rotational orientation of the glide rod 146. The second glide hole 156 comprises a flat edge 162 positioned to engage the indentations 161 of the glide rod 146 to prevent movement of glider 128 along the glide rod 146. In operation, the glide rod 146 is adapted to rotate the glide rod 146 between a first position in which the indentations 161 can be aligned with the flat edge 162 of the second glide hole 156 preventing the glider 128 from moving on the glide rod 128 and a second position in which the indentations 161 are out of alignment with the flat edge 162 allowing the glider 128 to move along the glide rod 146.

Figure 31:
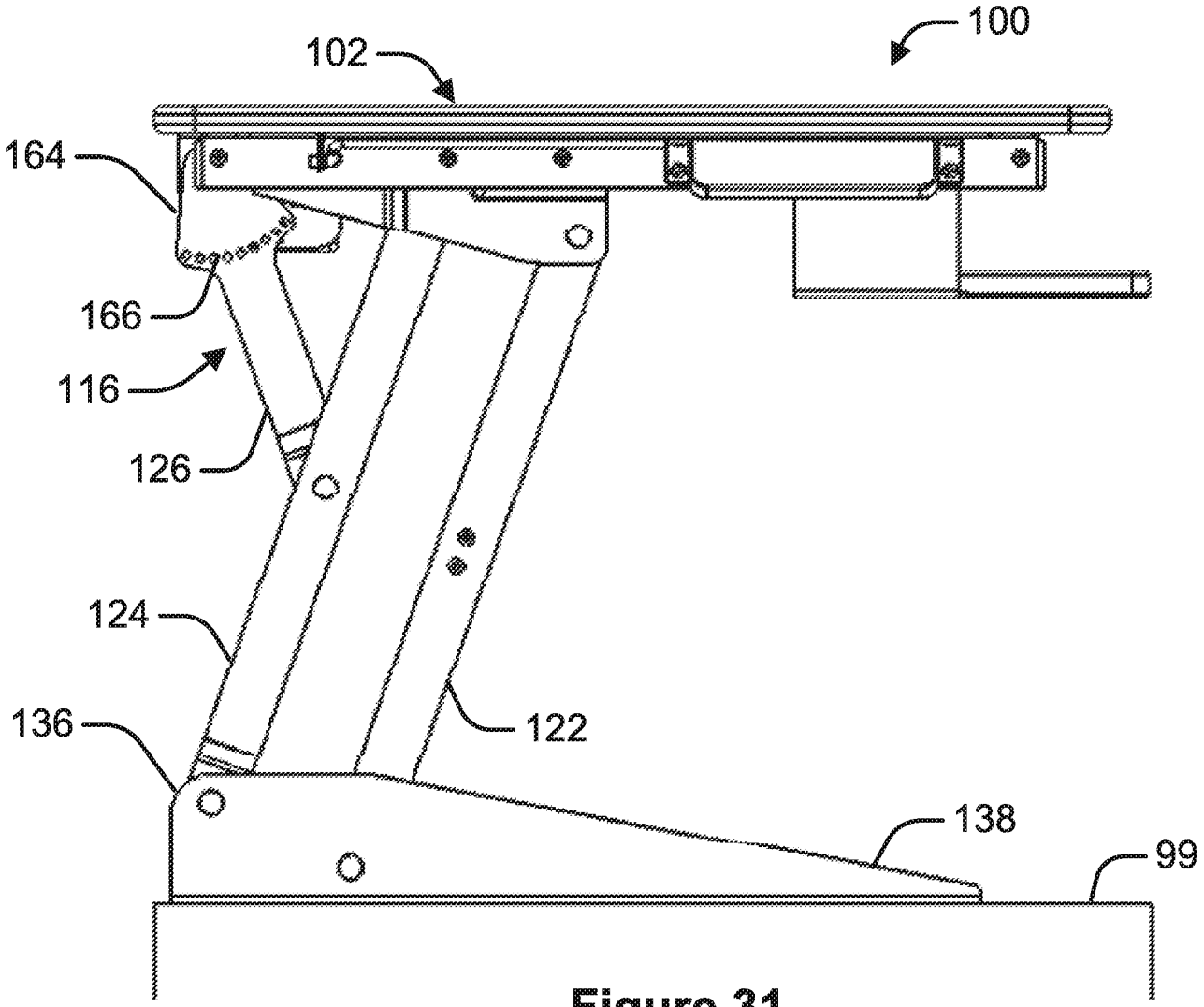
FIG. 31 is a side view of the height adjustable desktop system having a work surface depicted in FIG. 30 of the present disclosure.
Figure 32:
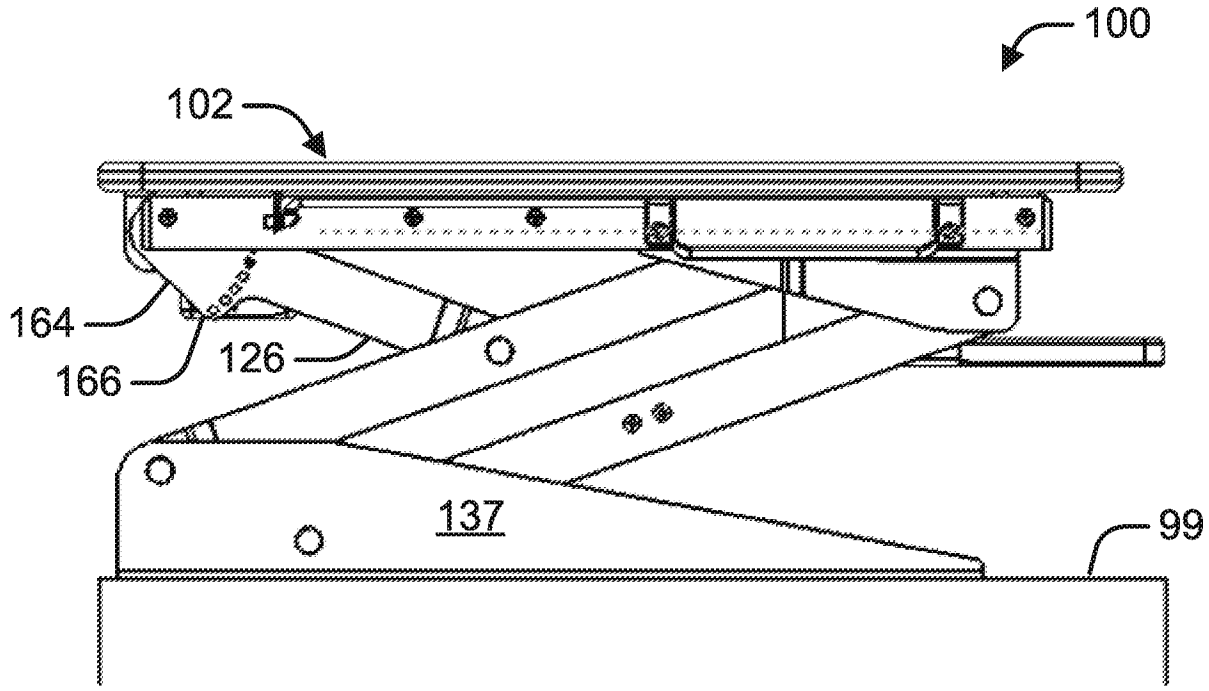
FIG. 32 is a side view of the height adjustable desktop system depicted in FIG. 30 having the work surface positioned in an intermediate lowered position, according to an example of the present disclosure.
Figure 34:
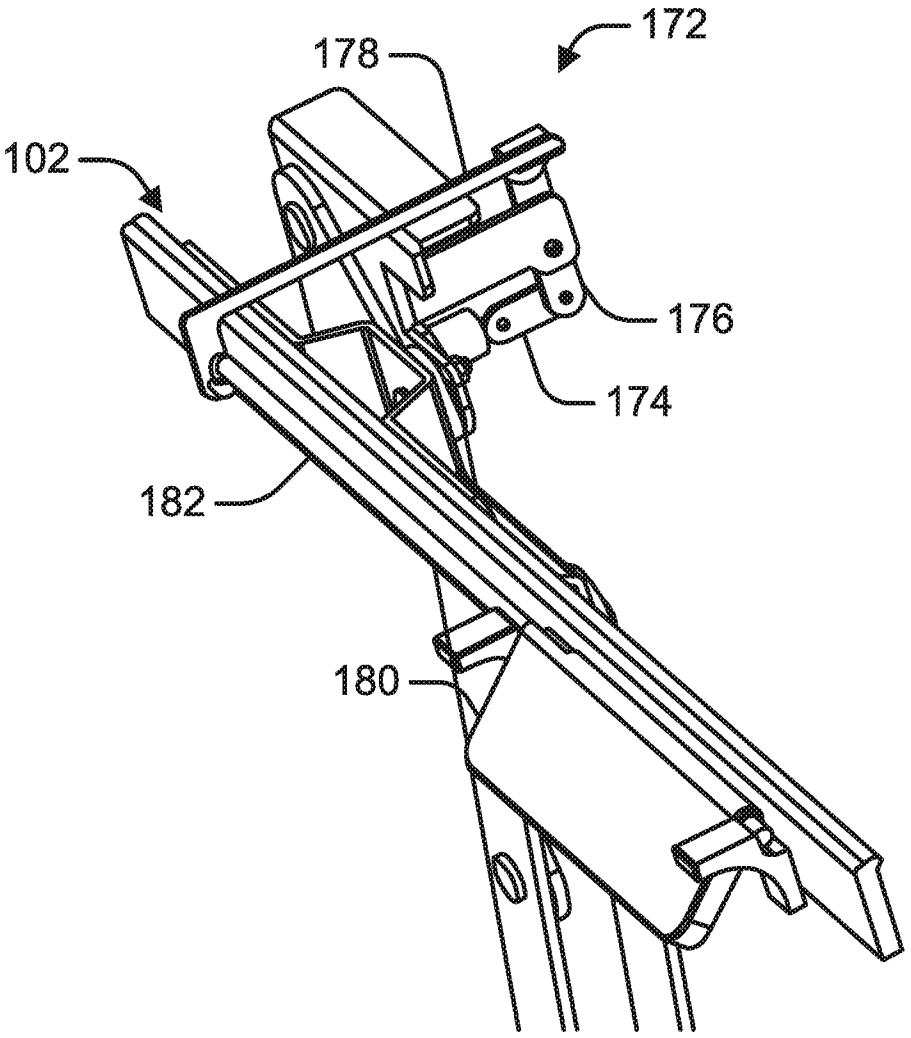
FIG. 34 is a partial perspective view of a lock lever assembly according to an example of the present disclosure.
Figure 35:
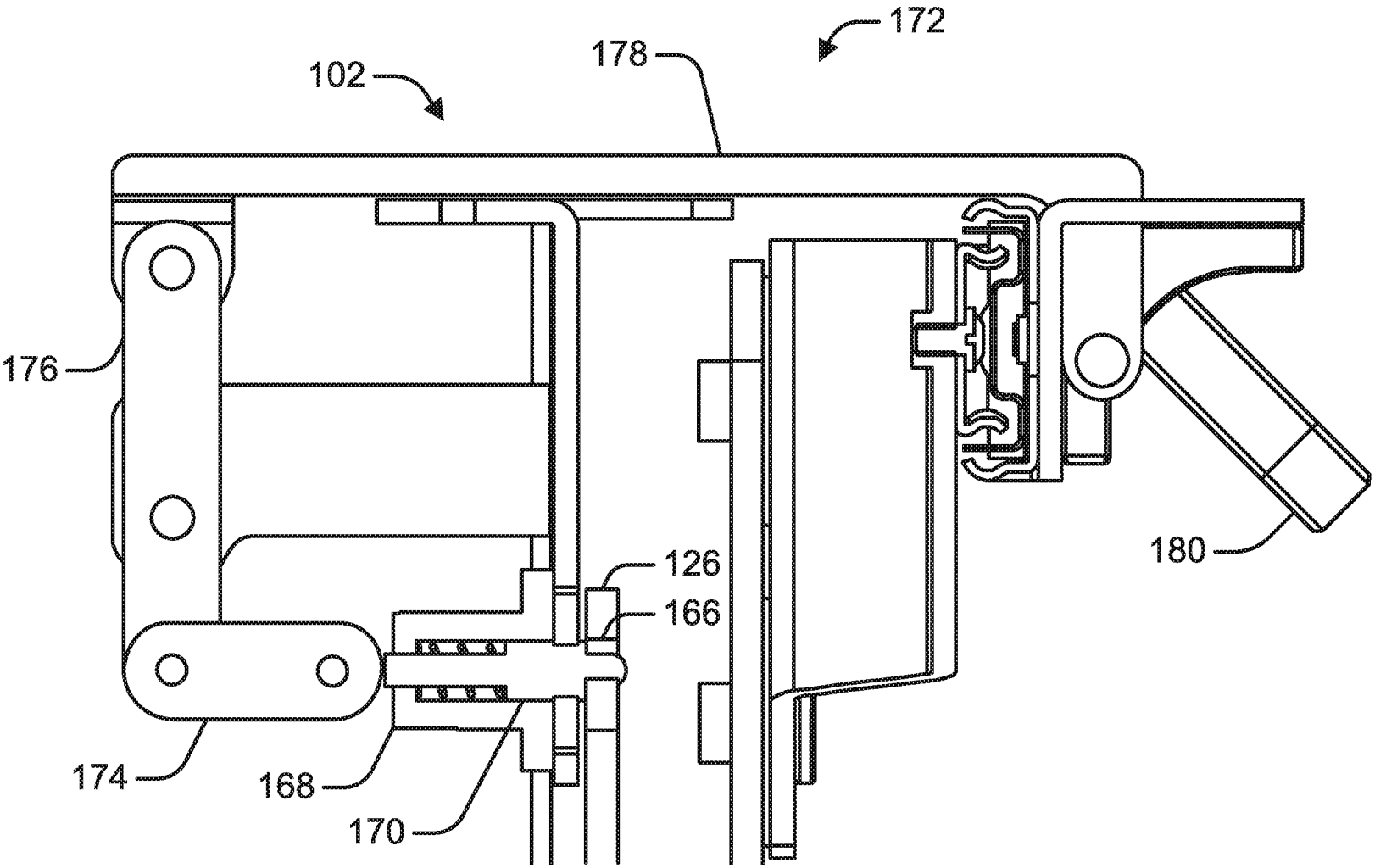
FIG. 35 is a partial cross-sectional side view of a lock lever assembly according to an example of the present disclosure.
Figure 36:
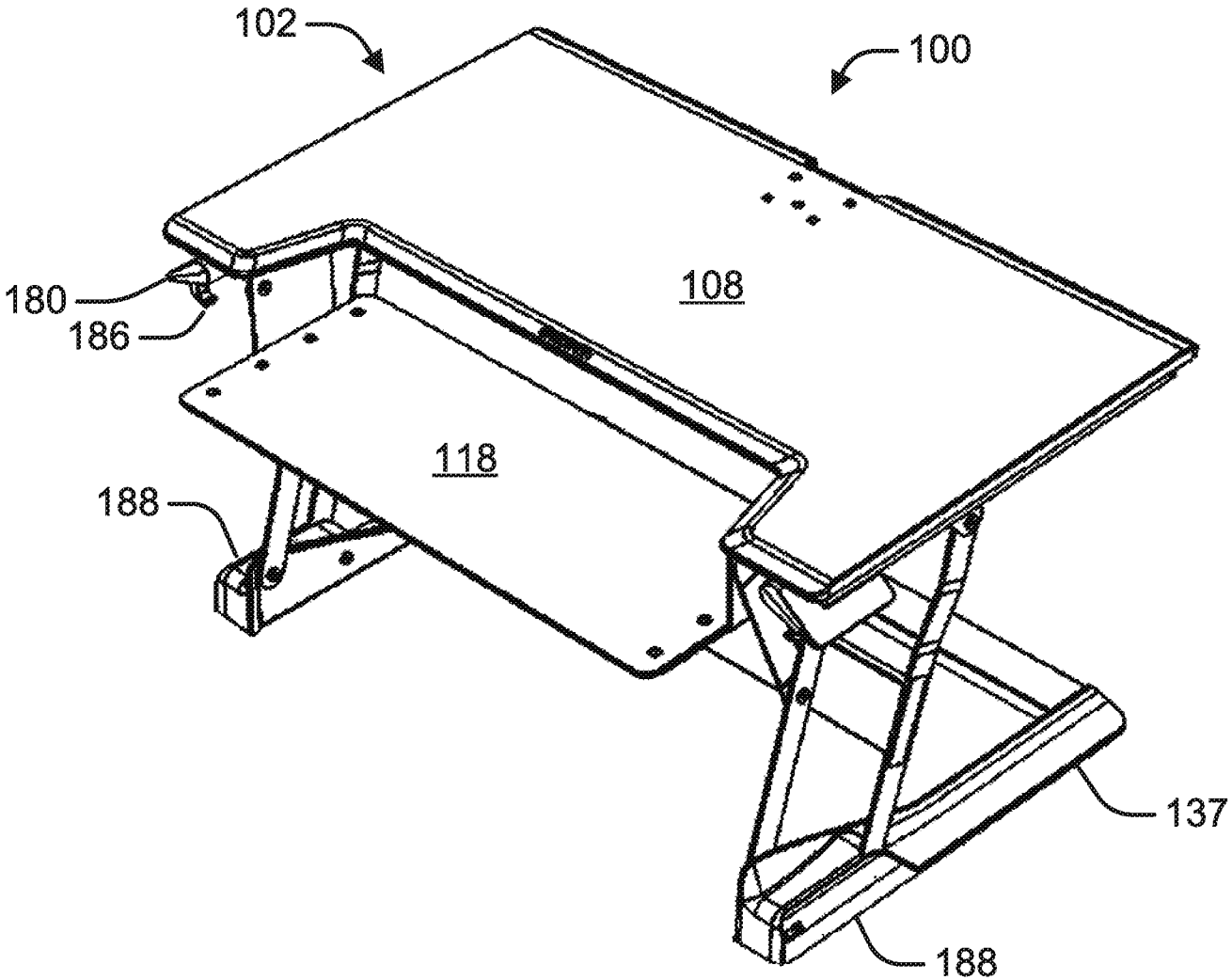
FIG. 36 is a perspective view of a height adjustable desktop system having a lower lock assembly, with a work surface positioned in an elevated position, according to an example of the present disclosure.
Figure 37:
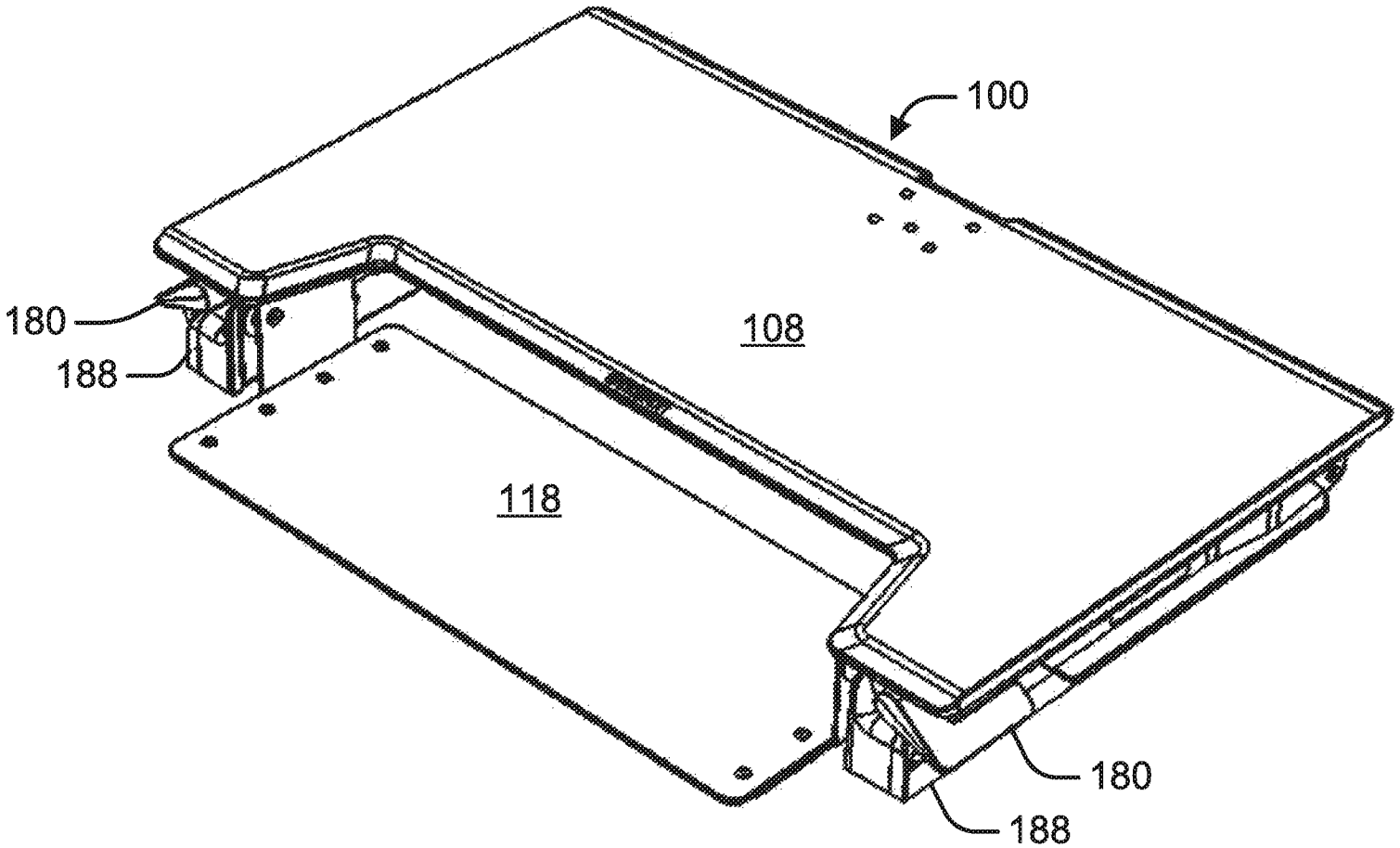
FIG. 37 is a perspective view of a height adjustable desktop system having a lower lock assembly, with a work surface positioned in a lowered and locked position, according to an example of the present disclosure.
Figure 38:
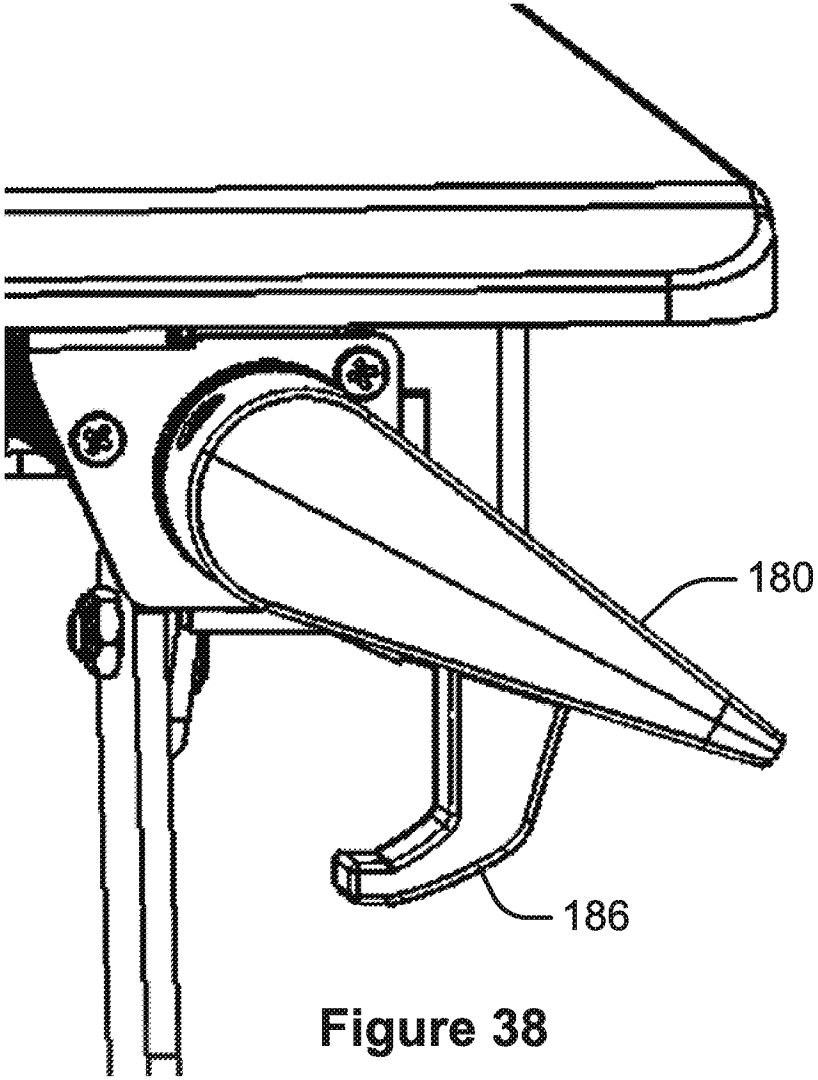
FIG. 38 is a perspective view of a lever having a locking arm according to an example of the present disclosure.
Figure 39:
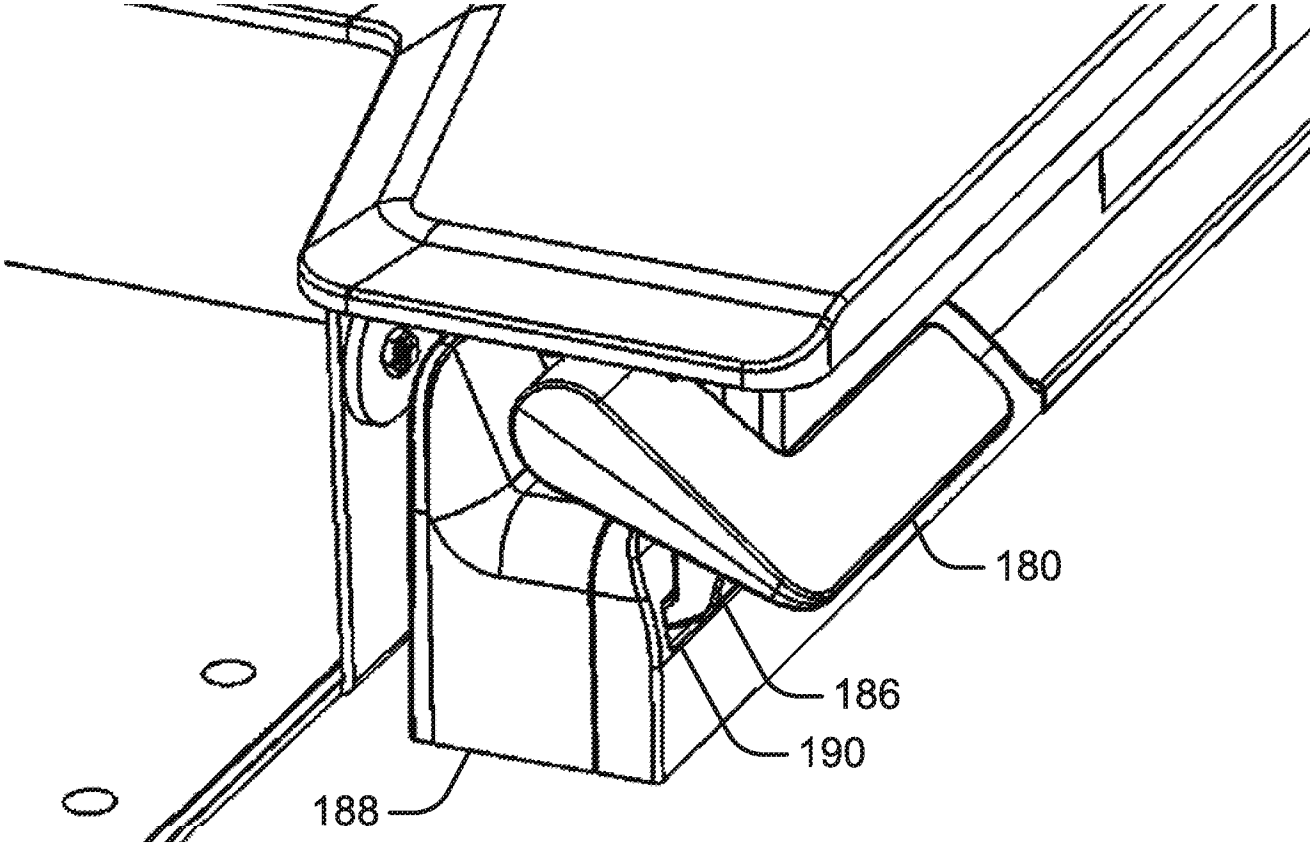
FIG. 39 is a partial perspective view of a height adjustable desktop system locked into a lowered position according to an example of the present disclosure.
Figure 40:
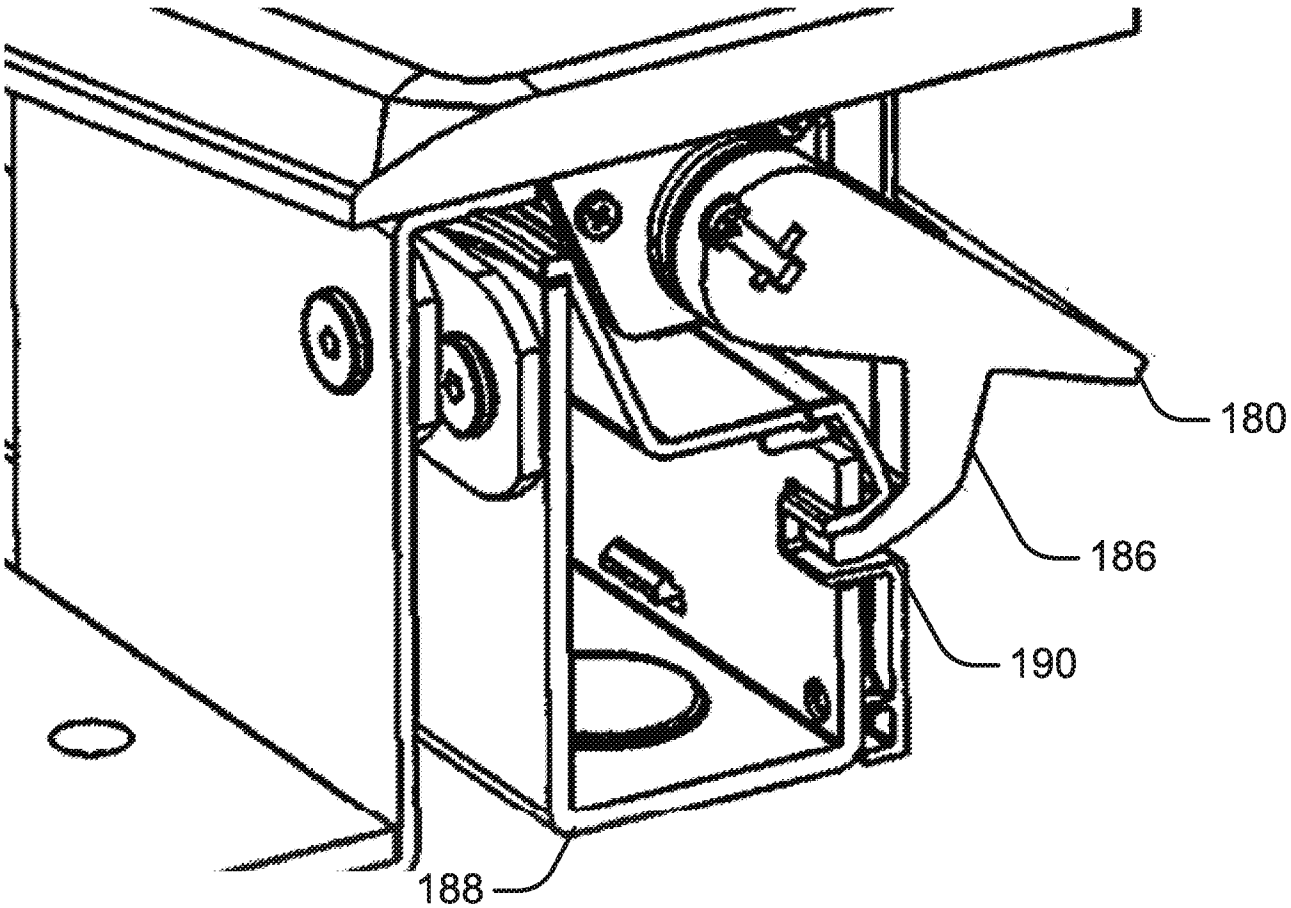
FIG. 40 is a cross-sectional perspective view of a height adjustable desktop system locked into a lowered position according to an example of the present disclosure.

As depicted in FIGS. 30-35, in an example, each transverse linkage 126 can include a fan portion 164 defining a plurality of holes 166 arranged in an arc. In this configuration, each adjustment assembly 120*a*, 120*b* can include a plunger 168 having a moving pin 170 extendable to engage one of the holes 166 in the transverse linkage 126 to prevent rotation of the transverse linkage 126 and raising or lowering of the work surface 120 as depicted in FIGS. 31-32 and 35. Similarly, the moving pin 170 can be retracted to disengage from the transverse linkage 126 to allow raising or lowering of the work surface 120 as depicted in FIGS. 31-32 and 35.

As depicted in FIGS. 33-35, in an example, each adjustment assembly 120*a*, 120*b* can include a lock lever assembly 172 can include a plunger bracket 174, rotating linkage 176 and a lever bracket 178. The plunger bracket 174 can be operably connected to the plunger pin 170 at one end and the rotatably connected to one end of the rotating linkage 176. The lever bracket 178 can be rotatably connected to the other end of the rotating linkage 176. In operation, pulling the lever bracket 178 rotates the rotating linkage 176 in a first direction, thereby pulling the plunger bracket 174 and retracting the pin 170 from the transverse linkage 126. Similarly, pushing the lever bracket 178 rotates the rotating linkage 176 in a second direction, thereby pushing the plunger bracket 174 and pushing the plunger pin 170 into engagement with the transverse linkage 126.

As depicted in FIGS. 33-35, in an example, the lock lever assembly 172 can include a lever 180 rotatably mounted to the lever bracket 178. The lever 180 can be pulled or pushed to operate the lever bracket 178 and correspondingly the plunger pin 170. In example, the lever 180 further can include an extended rod 182 for operably connecting the lever 180 to the lever bracket 178. The extended rod 182 can be sized to position the lever 180 at a convenient position relative to the work surface 102 for access to the lever 180.

As depicted in FIGS. 36-40, in an example, the height adjustable desktop system 100 can further include a lock lever assembly 184 that can lock the work surface 102 in the lowered position. The lever 180 can fiirther include a hook arm 186 rotatable between a lock position (shown in FIG. 38) and a release position. The foot portion 132 can also include at least one lock housing 188 corresponding to each hook arm 186. Each lock housing 188 can define at least one lock notch 190. In operation, the work surface 102 can be positioned in the lowered position and the lever 180 rotated to position the hook arm 186 in the lock position such that the hook arm 186 engages the lock notch 190. The engagement of the hook ami 186 to the lock housing 188 maintains the work surface 102 in the lowered position. The lever 180 can be rotated to position the hook arm 186 into the release position in which the hook arm 186 disengages from the hook arm 186 allowing the work surface 102 to be raised into the elevated position.

Each of these non-limiting examples can stand on its own, or can be combined in any permutation or combination with any one or more of the other examples.

The above detailed description can include references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." in this document, the term "or" is used to refer to a nonexclusive or, such that "A or B" can include "A but not B," "B but not" and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that can include elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A height adjustable desktop system, comprising:

a first platform defining an underside and including a glide rod and a support bracket positioned on the underside of the first platform;

a foot assembly including at least one foot bracket;

an adjustment assembly including:

a glider slidable on the glide rod between a first position proximate to a first end of the support bracket and a second position distal to the first end of the support bracket;

a first linkage rotatably connected to the glider and rotatably connected to the foot bracket, wherein the first linkage is rotatable within a first plane;

a second linkage rotatable within a second plane parallel to and offset from the first plane; and a transverse linkage rotatably connected to the support bracket and rotatably connected to the second linkage;

a handle movably coupled to the underside of the worksurface;

a lock assembly including:

the glide rod;

the glider;

the handle; and wherein the lock assembly includes an engaged configuration and a disengaged configuration:

in the engaged configuration, the lock assembly immobilizes linear translation of the glider with respect to the glide rod and the handle, in the disengaged configuration, the lock assembly allows the linear translation of the glider with respect to the glide rod and the handle, and wherein movement of the handle changes the lock assembly between the engaged configuration and the disengaged configuration; and wherein the glide rod extends through first and second through-holes of the glider, wherein the first through-hole has a circular profile, and the second through-hole has a non-circular profile.

2. The height adjustable desktop system of claim 1, further comprising a bushing coupled with at least the glider, wherein the bushing provides guidance between the glide rod and the glider during the linear translation of the glider with the lock assembly in the disengaged configuration.

3. The height adjustable desktop system of claim 1, wherein the glide rod includes a plurality of indentations, and wherein:

in the engaged configuration, the glider is engaged with at least one of the plurality of indentations to immobilize the glider with respect to the glide rod and the handle, and in the disengaged configuration, the glider is disengaged from the plurality of indentations to allow the linear translation of the glider with respect to the glide rod and the handle.

4. The height adjustable desktop system of claim 3, further comprising a flat edge partially defining the second through-hole, wherein in the engaged configuration the flat edge is engaged with the glide rod to immobilize linear translation of the glider with respect to the glide rod.

5. The height adjustable desktop system of claim 1, wherein the handle is configured to engage an end of the glide rod and allow a user to rotate the glide rod with respect to the support bracket.

6. The height adjustable desktop system of claim 1, wherein the support bracket defines two opposing bores configured to receive and support the glide rod.

7. The height adjustable desktop system of claim 6, wherein the first, second and transverse linkages are:

extended when the glider is positioned in the first position to position the first platform at an elevated position, and collapsed when the glider is positioned in the second position to position the first platform at a lowered position.

8. The height adjustable desktop system of claim 1, further comprising a counterbalance mechanism including a biasing member configured to bias the first platform toward an elevated position.

9. The height adjustable desktop system of claim 1, further comprising:

a second platform connected to the first platform; and wherein the second platform is suspended from the first platform.

10. The height adjustable desktop system of claim 9, wherein the adjustment assembly positions the second platform below the bottom surface of the foot assembly in the lowered position and positions the second platform above the bottom surface of the foot assembly in the elevated position.

11. The height adjustable desktop system of claim 1, wherein the second linkage is rotatable with the first linkage, the second linkage rotatably connected to the glider and rotatably connected to the foot bracket.

12. A height adjustable desktop system, comprising:

a platform defining an underside;

a first glide rod and a first support bracket positioned on the underside of the platform;

a second glide rod and a second support bracket positioned on the underside of the platform;

a foot assembly including at least one foot bracket;

an adjustment assembly including:

a first glider slidable on the first glide rod between a first position proximate to a first end of the support bracket and a second position distal to the first end of the support bracket;

a second glider slidable on the second glide rod;

a first linkage rotatably connected to the first glider and rotatably connected to the foot bracket, wherein the first linkage is rotatable within a first plane;

a second linkage rotatable within a second plane parallel to and offset from the first plane; and a transverse linkage rotatably connected to the first support bracket and rotatably connected to the second linkage;

a handle movably coupled to the underside of the worksurface;

a lock assembly connected between the handle and the first glider, wherein the lock assembly includes:

the first glide rod;

the first glider;

the handle; and wherein the lock assembly includes an engaged configuration and a disengaged configuration:

in the engaged configuration, the lock assembly immobilizes linear translation of the glider with respect to the glide rod, in the disengaged configuration, the lock assembly allows the linear translation of the first glider with respect to the first glide rod, and wherein movement of the handle changes the lock assembly between the engaged configuration and the disengaged configuration; and wherein the lock assembly extends through first and second through-holes of the first glider, wherein the first-through-hole has a circular profile, and the second through-hole has a non-circular profile.

13. The height adjustable desktop system of claim 12, further comprising a flat edge partially defining the second through-hole wherein in the engaged configuration, the flat edge is engaged with the first glide rod to immobilize linear translation of the first glider with respect to the glide rod.

14. The height adjustable desktop system of claim 12, wherein the first glide rod includes a first planar face and the first glider includes a second planar face opposing the first planar face, the second planar face configured to slidably engage the first planar face as the first glider moves.

15. The height adjustable desktop system of claim 12, further comprising a bushing wherein the bushing is coupled with at least the first glider, wherein the bushing provides guidance between the first glide rod and the first glider during the linear translation of the first glider with the lock assembly in the disengaged configuration.

16. The height adjustable desktop system of claim 12, wherein the glide rod includes a plurality of indentations and wherein:

in the engaged configuration, the glider is engaged with at least one of the plurality of indentations to immobilize the glider with respect to the slide rod and the handle, and in the disengaged configuration, the glider is disengaged from the plurality of indentations to allow the linear translation of the glider with respect to the glide rod and the handle.

17. A height adjustable desktop system, comprising:

a platform defining an underside and including a glide rod and a support bracket positioned on the underside of the platform;

a foot assembly including at least one foot bracket;

an adjustment assembly including:

a glider slidable on the glide rod between a first position proximate to the support bracket and a second position distal to the support bracket;

a first linkage rotatably connected to the glider and rotatably connected to the foot bracket, wherein the first linkage is rotatable within a first plane;

a second linkage rotatable within a second plane parallel to and offset from the first plane, wherein the second linkage is rotatable with the first linkage, the second linkage rotatably connected to the glider and rotatably connected to the foot bracket; and a transverse linkage rotatably connected to the support bracket and rotatably connected to the second linkage, wherein the first, second and transverse linkages are:

extended when the glider is positioned in the first position to position the platform at an elevated position, and collapsed when the glider is positioned in the second position to position the platform at a lowered position;

a handle movably coupled to the underside of the worksurface; and a lock assembly including:

the glide rod;

the glide;

the handle; and wherein the lock assembly includes an engaged configuration and a disengaged configuration:

in the engaged configuration, the lock assembly immobilizes linear translation of the glider with respect to the glide rod and the handle, in the disengaged configuration, the lock assembly allows the linear translation of the glider with respect to the glide rod and the handle, and wherein movement of the handle changes the lock assembly between the engaged configuration and the disengaged configuration; and wherein the glide rod extends through first and second through-holes of the glider, wherein the first through-hole has a circular profile, and the second through-hole has a non-circular profile.

18. The height adjustable desktop system of claim 17, further comprising a bushing wherein the bushing is coupled with at least the glider, wherein the bushing provides guidance between the glide rod and the glider during the linear translation of the glider with the lock assembly in the disengaged configuration.

19. The height adjustable desktop system of claim 17, wherein the glide rod includes a plurality of indentations and wherein:

in the engaged configuration, the glider is engaged with at least one of the plurality of indentations to immobilize the glider with respect to the glide rod and the handle, and in the disengaged configuration, the glider is disengaged from the plurality of indentations to allow the linear translation of the glider with respect to the glide rod and the handle.

20. The height adjustable desktop system of claim 19, further comprising a flat edge partially defining the second through-hole, and in the engaged configuration, the flat edge is engaged with the glide rod to immobilize linear translation of the glider with respect to the glide rod.

* * * * *